US012096817B2

(12) United States Patent
Yoshida et al.

(10) Patent No.: US 12,096,817 B2
(45) Date of Patent: Sep. 24, 2024

(54) SOLE STRUCTURE AND SHOES HAVING THE SAME

(71) Applicant: MIZUNO CORPORATION, Osaka (JP)

(72) Inventors: Yohei Yoshida, Osaka (JP); Kouji Ito, Osaka (JP)

(73) Assignee: MIZUNO CORPORATION, Osaka (JP)

( * ) Notice: Subject to any disclaimer, the term of this patent is extended or adjusted under 35 U.S.C. 154(b) by 2 days.

(21) Appl. No.: 17/571,709

(22) Filed: Jan. 10, 2022

(65) Prior Publication Data

US 2022/0312890 A1 Oct. 6, 2022

(30) Foreign Application Priority Data

Mar. 31, 2021 (JP) ..... 2021-060939

(51) Int. Cl.
*A43B 13/12* (2006.01)
*A43B 7/144* (2022.01)
(Continued)

(52) U.S. Cl.
CPC ..... *A43B 13/127* (2013.01); *A43B 7/144* (2013.01); *A43B 13/04* (2013.01); *A43B 13/14* (2013.01)

(58) Field of Classification Search
CPC ..... A43B 13/127; A43B 13/12; A43B 13/125; A43B 13/04; A43B 13/14; A43B 13/186; A43B 13/181; A43B 7/144
(Continued)

(56) References Cited

U.S. PATENT DOCUMENTS 4,794,707 A * 1/1989 Franklin ..... A43B 7/148 36/31
6,647,645 B2 * 11/2003 Kita ..... A43B 13/12 36/31
(Continued)

FOREIGN PATENT DOCUMENTS

JP 2007135827 A 6/2007
JP 2007307378 A 11/2007
(Continued)

OTHER PUBLICATIONS

Office Action dated Aug. 23, 2022 issued in Japanese Patent Application No. JP 2021-060939.
(Continued)

*Primary Examiner* — Khoa D Huynh
*Assistant Examiner* — Haley A Smith
(74) *Attorney, Agent, or Firm* — Troutman Pepper Hamilton Sanders LLP; James E. Schutz; Korbin M. Blunck

(57) ABSTRACT

To achieve a favorable feeling particularly during running. A midsole includes: a first midsole portion; and a second midsole portion stacked on the first midsole portion in a thickness direction of the midsole and made of a material having a lower hardness than a material forming the first midsole portion. In a cutting plane when the midsole is cut along a foot width direction at a location corresponding to the sustentaculum tali of a foot of a wearer, the first midsole portion and the second midsole portion have a relatively-low hardness at a location corresponding to the calcaneus of the wearer, and a relatively-high hardness in an area ranging from a location corresponding to the sustentaculum tali to a medial instep side.

12 Claims, 20 Drawing Sheets

(51) Int. Cl.
*A43B 13/04* (2006.01)
*A43B 13/14* (2006.01)

(58) Field of Classification Search
USPC ..... 36/107, 108
See application file for complete search history.

(56) References Cited

U.S. PATENT DOCUMENTS

2007/0107258 A1 5/2007 Umezawa et al.
2008/0052960 A1 3/2008 Belley et al.
2009/0056165 A1* 3/2009 Lee ..... A43B 13/12 36/108
2010/0170106 A1* 7/2010 Brewer ..... A43B 13/187 36/35 R
2011/0179669 A1* 7/2011 Hanebrink ..... A43B 21/265 36/28
2011/0214310 A1* 9/2011 Rosenbaum ..... A43B 13/18 36/28
2013/0081306 A1 4/2013 Park et al.
2014/0310981 A1* 10/2014 Abshire ..... A43B 7/1425 36/28
2014/0331517 A1* 11/2014 Seo ..... A43B 7/32 36/28
2015/0000161 A1* 1/2015 Peyton ..... A43B 3/246 36/103
2015/0272269 A1* 10/2015 Niskanen ..... A43B 7/144 36/30 R
2017/0095034 A1* 4/2017 Dupre ..... A43B 7/148
2018/0020772 A1* 1/2018 Mitchell ..... A43B 17/003 36/43
2018/0153253 A1* 6/2018 Ward ..... A43B 13/186
2018/0199666 A1* 7/2018 Moriyasu ..... A43B 23/028
2018/0255870 A1* 9/2018 Oda ..... A43B 7/1415
2020/0305545 A1* 10/2020 Yahata ..... A43B 7/1435

FOREIGN PATENT DOCUMENTS

JP 2012528661 A 11/2012
JP 5568699 B1 8/2014

OTHER PUBLICATIONS

Japanese Office Action dated June 7. 2022 issued in Japanese Patent Application No. 2021-060939.

* cited by examiner

SOLE STRUCTURE AND SHOES HAVING THE SAME

CROSS-REFERENCE TO RELATED APPLICATION

This application claims priority to Japanese Patent Application No. 2021-060939 filed on Mar. 31, 2021, the entire disclosure of which is incorporated by reference herein.

BACKGROUND

The present disclosure relates to a sole structure and a shoe having such a sole structure.

Sole structures for a shoe have been proposed like a sole structure of Japanese Patent No. 5568699, for example.

Japanese Patent No. 5568699 discloses a shoe sole structure including an outsole and a midsole stacked on an upper side of the outsole and made of a soft elastic material. In a cutting plane when the sole structure is cut along a foot width direction, a midsole portion has a substantially constant vertical thickness from an inner side to an outer side along the foot width direction.

SUMMARY

In general, a runner who prefers efficient running with a better feeling of running tends to require a sole structure for running shoes to have cushioning properties when the running shoes contact a ground or road surface during running (hereinafter referred to as "upon grounding"). Upon grounding, an impact (an initial impact) mainly in the vertical up-down direction is generated around a heel portion of a foot of a wearer (particularly, a bottom portion of a calcaneal tuber). The above-described impact is appropriately attenuated by the cushioning properties.

On the other hand, a sole structure with higher cushioning properties tends to make the calcaneus instable, and tends to generate a phenomenon called overpronation in which the calcaneus of the foot of the wearer excessively falls inward of the sustentaculum tali as a starting point after the grounding. Such overpronation causes a burden on various portions of a lower limb linked to the calcaneus, and a running disorder accompanied by chronic pain may occur at these portions.

Here, in the sole structure of Japanese Patent No. 5568699, as described above, in the cutting plane when the sole structure is cut along the foot width direction, the midsole portion has a substantially constant vertical thickness from the inner side to the outer side along the foot width direction. That is, this sole structure uniformly exhibits the cushioning properties of the midsole in the foot width direction not only at the bottom portion of the calcaneal tuber of the foot of the wearer but also at a location corresponding to the sustentaculum tali as the starting point of pronation. However, such a configuration tends to cause instability of the entire calcaneus including the sustentaculum tali portion of the foot of the wearer due to the cushioning properties of the midsole, possibly resulting in promoting the overpronation.

The present disclosure has been made in view of the foregoing background, and it is an object of the present disclosure to achieve a favorable feeling particularly during running.

In order to achieve the above-described object, a first aspect of the present disclosure is directed to a sole structure for a shoe, the sole structure including a midsole. The midsole has a first midsole portion, and a second midsole portion disposed at a location corresponding at least to a hindfoot portion of a foot of a wearer. The second midsole portion is stacked on the first midsole portion in a thickness direction of the midsole, and is made of a material having a lower hardness than a material forming the first midsole portion. The first midsole portion and the second midsole portion have a relatively-low hardness at a location corresponding to a tuber bottom portion of a calcaneus of the foot of the wearer, and a relatively-high hardness in an area ranging from a location corresponding to a sustentaculum tali of the foot of the wearer to a location corresponding to a navicular of the foot of the wearer.

In the first aspect of the present disclosure, the first midsole portion and the second midsole portion have a relatively-low hardness at the location corresponding to the tuber bottom portion of the calcaneus of the foot of the wearer. Such a configuration improves cushioning properties at the locations corresponding to the tuber bottom portion of the calcaneus of the foot of the wearer at the first midsole portion and the second midsole portion. Such cushioning properties attenuate an impact particularly on a heel portion of the wearer upon grounding during running. On the other hand, the first midsole portion and the second midsole portion have a relatively-high hardness in the area ranging from the location corresponding to the sustentaculum tali of the foot of the wearer to the location corresponding to the navicular of the foot of the wearer. Such a configuration relatively enhances rigidity though relatively degrades the cushioning properties in the area ranging from the location corresponding to the sustentaculum tali of the foot of the wearer to the location corresponding to the navicular of the foot of the wearer at the first midsole portion and the second midsole portion. Such rigidity improves supporting properties particularly at the location of the sustentaculum tali of the wearer. Specifically, the first midsole portion and the second midsole portion stably support the location of the sustentaculum tali of the wearer. This reduces occurrence of a phenomenon (so-called overpronation) in which the heel portion becomes instable and excessively falls inward after grounding. As described above, in the sole structure, the cushioning properties appropriately attenuate impact on the heel portion of the wearer while the supporting properties reduce occurrence of the overpronation. Thus, the first aspect of the disclosure can achieve a favorable feeling particularly during running.

A second aspect of the disclosure is an embodiment of the first aspect. In the second aspect, the second midsole portion includes a plurality of thin plate portions with a thin plate shape. In a cutting plane when the midsole is cut along a foot width direction at a location corresponding to the sustentaculum tali of the foot of the wearer, the thin plate portions are stacked such that inner side portions of the thin plate portions each form a step in the thickness direction of the midsole. In the cutting plane, the second midsole portion is relatively thick at a location corresponding to the tuber bottom portion of the calcaneus of the foot of the wearer, and relatively thin in an area ranging from a location corresponding to the sustentaculum tali of the foot of the wearer to a location corresponding to the navicular of the foot of the wearer.

According to the second aspect of the disclosure, the proportion of the second midsole portion relatively increases at the location corresponding to the tuber bottom portion of the calcaneus of the foot of the wearer in the above-described cutting plane. This improves the cushioning properties. On the other hand, the proportion of the first midsole portion relatively increases in the area ranging from the location corresponding to the sustentaculum tali of the foot of the wearer to the location corresponding to the navicular of the foot of the wearer in the above-described cutting plane. This relatively enhances the rigidity though relatively degrades the cushioning properties. Therefore, the cushioning properties appropriately attenuate the impact on the heel portion of the wearer while the supporting properties reduce occurrence of the overpronation. Thus, the second aspect of the disclosure can achieve a favorable feeling particularly during running.

A third aspect of the disclosure is an embodiment of the first or second aspect. In the third aspect, the first midsole portion includes: an upper midsole portion whose upper surface is a planta contact surface contacting a planta of the wearer; and a lower midsole portion stacked below the upper midsole portion. The first midsole portion includes, at a recessed portion formed at least at one of the upper midsole portion or the lower midsole portion, a space serving as a housing portion for housing the second midsole portion.

The third aspect of the disclosure achieves a specific configuration providing the advantages of the first aspect of the disclosure.

A fourth aspect of the disclosure is an embodiment of the third aspect. In the fourth aspect, the recessed portion is surrounded by a peripheral wall portion formed at least at one of the upper midsole portion or the lower midsole portion, and a wall thickness of the peripheral wall portion is larger on an inner side of the recessed portion in the foot width direction than on an outer side of the recessed portion in the foot width direction.

In the fourth aspect of the present disclosure, the wall thickness of the peripheral wall portion surrounding the recessed portion is larger on the inner side of the recessed portion in the foot width direction than on the outer side of the recessed portion in the foot width direction. Therefore, the proportion of the second midsole portion relatively increases at the location corresponding to the tuber bottom portion of the calcaneus of the foot of the wearer to easily improve the cushioning properties. On the other hand, the proportion of the first midsole portion relatively increases in the area ranging from the location corresponding to the sustentaculum tali of the foot of the wearer to the location corresponding to the navicular of the foot of the wearer. This relatively easily enhances the rigidity though relatively degrades the cushioning properties. Therefore, the cushioning properties appropriately attenuate the impact on the heel portion of the wearer while the supporting properties reduce occurrence of the overpronation. Thus, the fourth aspect of the disclosure can achieve a favorable feeling particularly during running.

A fifth aspect of the disclosure is an embodiment of the third or fourth aspect. In the fifth aspect, the upper midsole portion is made of a material having a higher hardness than a material forming the lower midsole portion. The upper midsole portion includes an upper recessed portion recessed upward from a lower portion of the upper midsole portion, and an upper peripheral wall portion located on inner and outer sides of the upper recessed portion in the foot width direction and protruding downward. The lower midsole portion includes a lower recessed portion recessed downward from an upper portion of the lower midsole portion, and a lower peripheral wall portion located on inner and outer sides of the lower recessed portion in the foot width direction and protruding upward. In the cutting plane when the midsole is cut along the foot width direction at the location corresponding to the sustentaculum tali of the foot of the wearer, the upper peripheral wall portion on the inner side in the foot width direction has a longer protruding length than the lower peripheral wall portion on the inner side in the foot width direction.

In the fifth aspect of the present disclosure, the proportion of the upper midsole portion relatively increases in the area ranging from the location corresponding to the sustentaculum tali of the foot of the wearer to the location corresponding to the navicular of the foot of the wearer in the above-described cutting plane. This relatively enhances the rigidity, which results in improving the supporting properties to reduce occurrence of the overpronation.

A sixth aspect of the disclosure is an embodiment of the third or fourth aspect. In the sixth aspect, the lower midsole portion is made of a material having a higher hardness than a material forming the upper midsole portion. The upper midsole portion includes an upper recessed portion recessed upward from a lower portion of the upper midsole portion, and an upper peripheral wall portion located on inner and outer sides of the upper recessed portion in the foot width direction and protruding downward. The lower midsole portion includes a lower recessed portion recessed downward from an upper portion of the lower midsole portion, and a lower peripheral wall portion located on inner and outer sides of the lower recessed portion in the foot width direction and protruding upward. In the cutting plane when the midsole is cut along the foot width direction at the location corresponding to the sustentaculum tali of the foot of the wearer, the lower peripheral wall portion on the inner side in the foot width direction has a longer protruding length than the upper peripheral wall portion on the inner side in the foot width direction.

In the sixth aspect of the present disclosure, the proportion of the lower midsole portion relatively increases in the area ranging from the location corresponding to the sustentaculum tali of the foot of the wearer to the location corresponding to the navicular of the foot of the wearer in the above-described cutting plane. This relatively enhances the rigidity, which results in improving the supporting properties to reduce occurrence of the overpronation.

A seventh aspect of the disclosure is an embodiment of any one of the third to sixth aspects. In the seventh aspect, the sole structure further includes an outsole stacked on a lower side of the lower midsole portion. A peripheral edge portion of the outsole on an inner side in the foot width direction has at least one outer wall portion standing upward from the peripheral edge portion, and the outer wall portion is disposed on an outer surface side of the lower midsole portion at least at a location corresponding to the hindfoot portion of the foot of the wearer.

In the seventh aspect of the disclosure, the outer wall portion enables reduction in compressive deformation of an inner region of the lower midsole portion due to the impact upon grounding. This can improve the supporting properties of the lower midsole portion in the inner region to reduce occurrence of the overpronation.

A eighth aspect of the disclosure is an embodiment of the first or second aspect. In the eighth aspect, the first midsole portion includes a housing portion recessed downward from an upper portion of the first midsole portion, and the second midsole portion is stacked on the first midsole portion while housed in the housing portion.

In the eighth aspect of the present disclosure, the second midsole portion is housed in the housing portion opening upward. Thus, the second midsole portion made of the material having the lower hardness than the first midsole portion is easily brought into contact with the location corresponding to the tuber bottom portion of the calcaneus of the foot of the wearer. This can relatively enhance the cushioning properties to further attenuate the impact on the heel portion of the wearer. Further, the entire lower surface of the first midsole portion serves as a grounding-side surface. This does not cause an uncomfortable feeling upon grounding due to a hardness difference at the above-described boundary portion.

A ninth aspect of the disclosure is an embodiment of the first or second aspect. In the ninth aspect, the first midsole portion includes a housing portion recessed upward from a lower portion of the first midsole portion, and the second midsole portion is stacked on the first midsole portion while housed in the housing portion.

In the ninth aspect of the present disclosure, the second midsole portion is housed in the housing portion opening downward. Thus, such a configuration enables the entire upper surface of the first midsole portion to serve as the planta contact surface, and disallows a boundary portion between the first midsole portion and the second midsole portion to contact the planta of the wearer. This does not cause an uncomfortable feeling of the planta of the wearer due to a hardness difference at the boundary portion.

A tenth aspect of the disclosure is an embodiment of the eighth or ninth aspect. In the tenth aspect, the first midsole portion includes a peripheral wall portion located on inner and outer sides of the housing portion in the foot width direction and serving as an inner wall surface of the housing portion, and in the cutting plane when the midsole is cut along the foot width direction at the location corresponding to the sustentaculum tali of the foot of the wearer, a wall thickness of the peripheral wall portion in the foot width direction is larger on the inner side in the foot width direction than on the outer side in the foot width direction.

According to the tenth aspect of the disclosure, the proportion of the second midsole portion relatively increases at the location corresponding to the tuber bottom portion of the calcaneus of the foot of the wearer in the above-described cutting plane. This improves the cushioning properties. On the other hand, the proportion of the first midsole portion relatively increases in the area ranging from the location corresponding to the sustentaculum tali of the foot of the wearer to the location corresponding to the navicular of the foot of the wearer in the above-described cutting plane. This relatively enhances the rigidity though relatively degrades the cushioning properties. Therefore, the cushioning properties appropriately attenuate the impact on the heel portion of the wearer while the supporting properties reduce occurrence of the overpronation. Thus, the tenth aspect of the disclosure can achieve a favorable feeling particularly during running.

An eleventh aspect of the disclosure is an embodiment of any one of the first to tenth aspects. In the eleventh aspect, the second midsole portion has a hardness difference of 15 C or more on an Asker C scale as compared to the first midsole portion.

According to the eleventh aspect of the disclosure, the hardness difference can clarify a difference between the cushioning properties at the location corresponding to the tuber bottom portion of the calcaneus of the foot of the wearer and the supporting properties in the area ranging from the location corresponding to the sustentaculum tali of the foot of the wearer to the location corresponding to the navicular of the foot of the wearer.

A twelfth aspect of the disclosure is an embodiment of any one of the first to eleventh aspects. In the eleventh aspect, the second midsole portion is made of rubber foam.

In the twelfth aspect of the disclosure, the rubber foam having a low hardness and a high repulsive force is used for the second midsole portion. This can achieve attenuation of the impact on the heel portion of the wearer and propulsion during running at the same time. Also, the rubber foam enables easy manufacturing of the second midsole portion.

A thirteenth aspect of the disclosure is directed to a shoe including the sole structure of any one of the first to twelfth aspects.

In the thirteenth aspect, shoes providing advantages similar to those of the first to twelfth aspects of the present disclosure can be obtained.

As described above, the present disclosure can achieve a favorable feeling particularly during running.

DETAILED DESCRIPTION

Embodiments of the present disclosure are described in detail with reference to the drawings. The following description of embodiments is only an example in nature, and is not intended to limit the scope, applications, or use of the present disclosure.

First Embodiment

Figure 1:
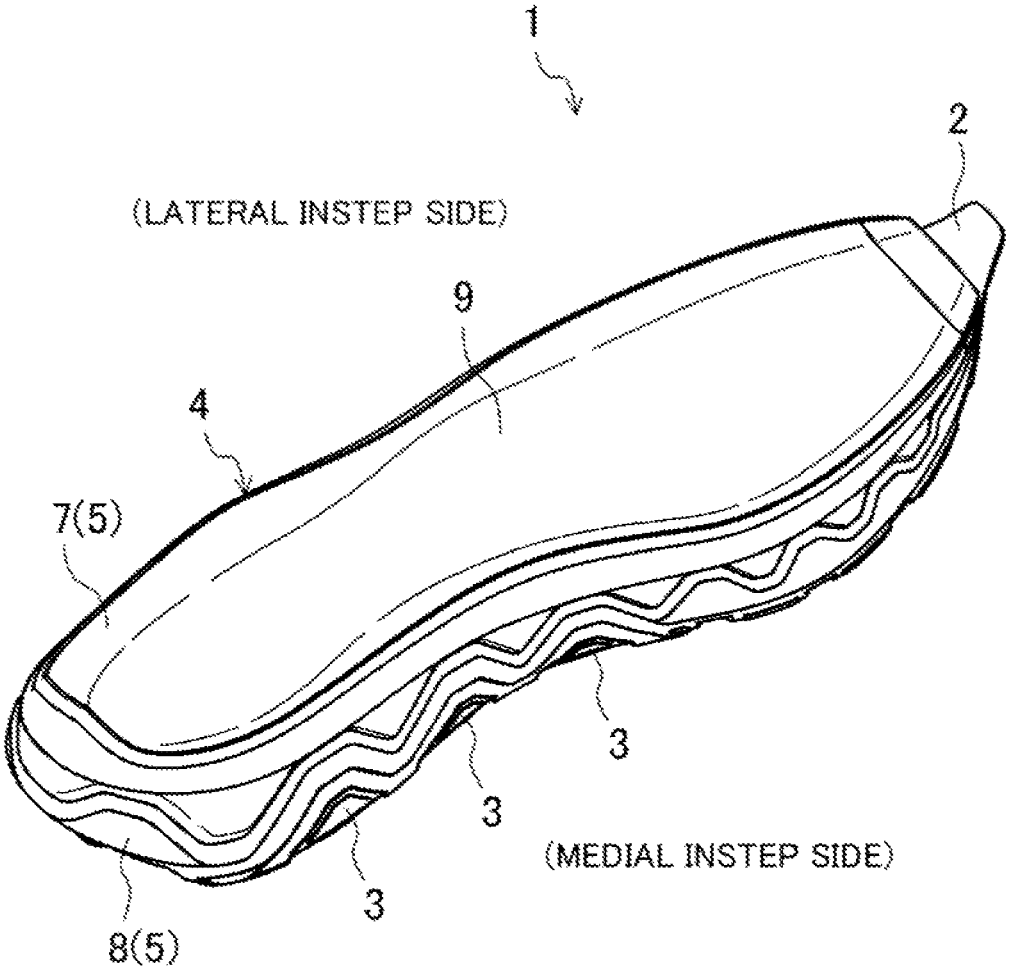
FIG. 1 is an overall perspective view illustrating a sole structure of a first embodiment.

FIG. 1 illustrates the entirety of a sole structure 1 according to a first embodiment of the present disclosure. A shoe including the sole structure 1 is used as, e.g., a sports shoe for running or various competitions.

The drawings show the sole structure 1 for a left shoe only. A sole structure for a right shoe is symmetrical to the sole structure 1 for the left shoe. Thus, only the sole structure for the left shoe will be described in the following description, and the description of the sole structure for the right shoe will be omitted herein.

In the following description, an upper side (upward, above) and a lower side (downward, below) represent a positional relationship in an up-down direction of the sole structure 1. Specifically, the upper side (upward, above) indicates a side (see FIG. 6) on which a planta contact surface 9 described later is located in the sole structure 1. The lower side (downward, below) indicates a side (see FIG. 6) on which an outsole 2 described later is located in the sole structure 1. Further, a front side and a rear side represent a positional relationship in a foot length direction of the sole structure 1. Specifically, the front side indicates the side (see FIG. 3) of the sole structure 1 at a location corresponding to a toe portion of a foot of a wearer. The rear side indicates the side (see FIG. 3) of the sole structure 1 at a location corresponding to a heel portion of the foot of the wearer. Further, an inner side and an outer side each indicate a medial instep side and a lateral instep side in the shoe including the sole structure 1, respectively. That is, with respect to the center (the center in a foot width direction) of the foot viewed in the foot length direction, a direction toward an opposing foot is referred to as the inner side, and a direction away from the opposing foot is referred to as the outer side. In addition, in FIG. 3, in the sole structure 1, an area corresponding to a forefoot portion of a foot ft of a person (hereinafter, referred to as a "wearer") wearing the shoe including the sole structure 1 is indicated by a reference sign F, an area corresponding to a midfoot portion of the foot ft of the wearer is indicated by a reference sign M, and an area corresponding to a hindfoot portion of the foot ft of the wearer is indicated by a reference sign H.

Figure 2:
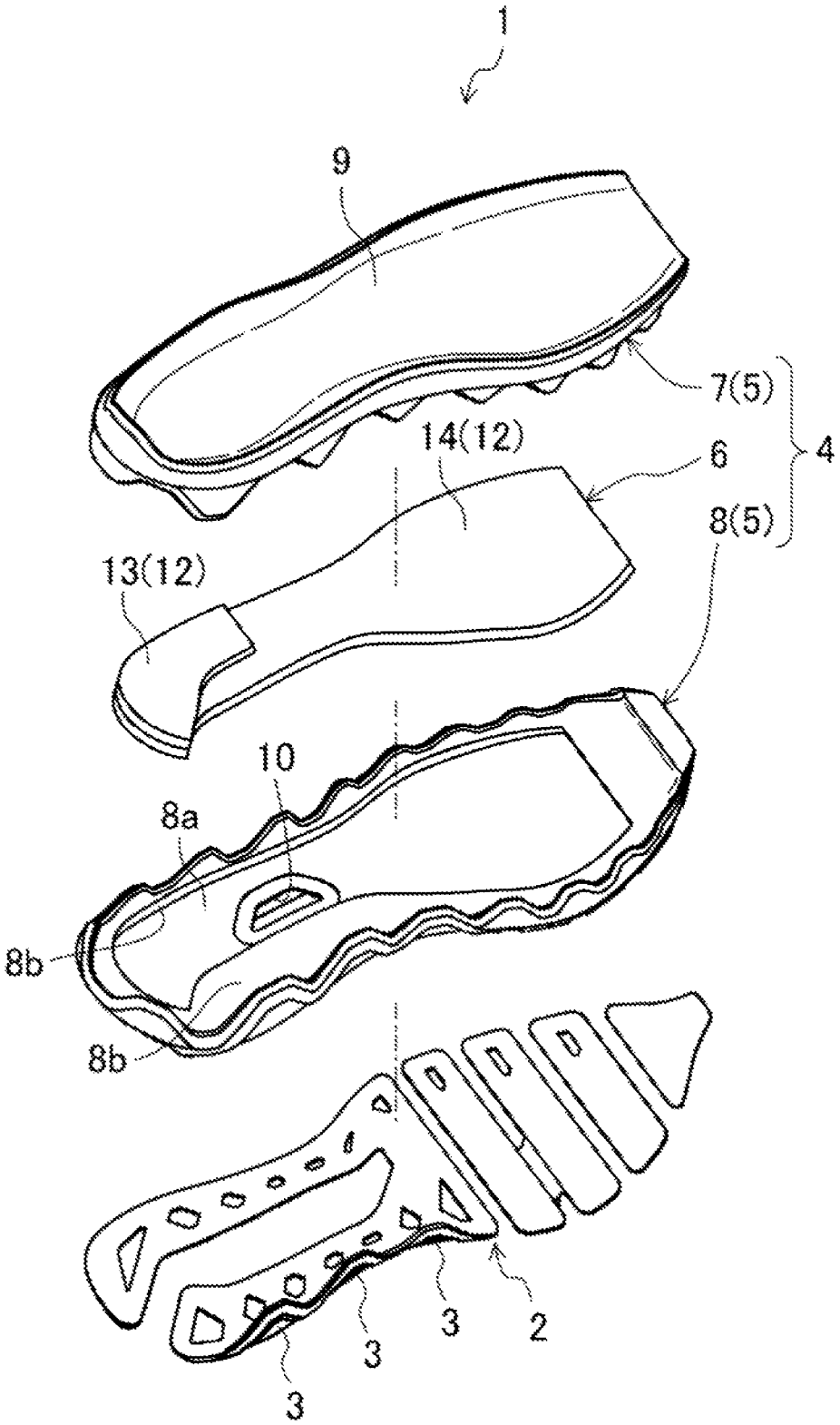
FIG. 2 is an exploded perspective view illustrating each configuration of the sole structure of the first embodiment.
Figure 3:
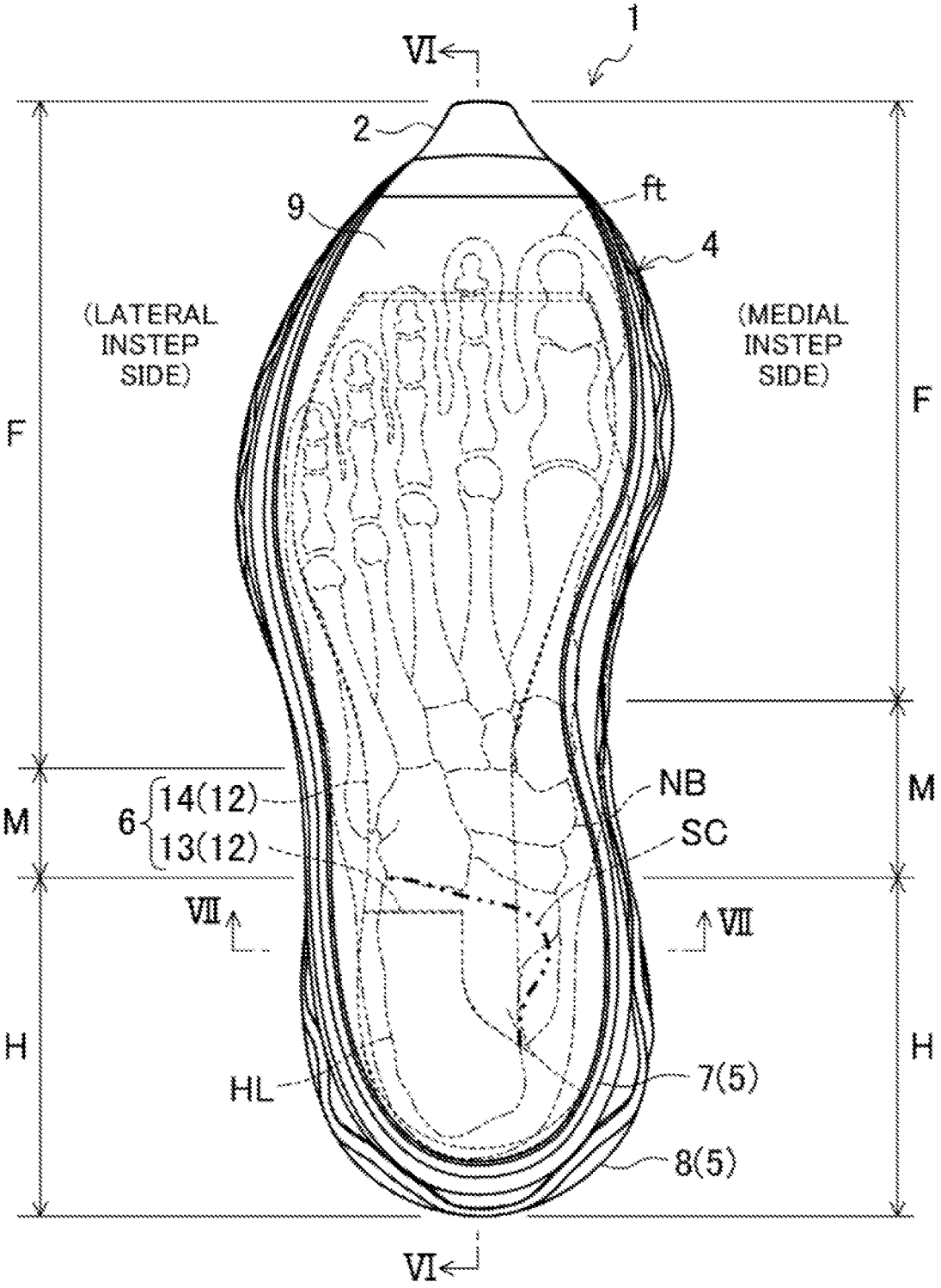
FIG. 3 is a top view virtually illustrating a state in which a skeletal structure of a foot of a wearer is on the sole structure of the first embodiment.

(Outsole) As illustrated in FIGS. 1 to 3, the sole structure 1 includes the outsole 2. In the sole structure 1, the outsole 2 is disposed corresponding to an area ranging from the forefoot portion F to the hindfoot portion H of the wearer.

The outsole 2 is formed of a hard elastic member having a higher hardness than a midsole 4 that will be described later. Specifically, examples of the material suitable for the outsole 2 include thermoplastic synthetic resins such as an ethylene-vinyl acetate copolymer (EVA), thermosetting resins such as polyurethane (PU), rubber such as butadiene rubber and chloroprene rubber, and foam materials obtained by foaming of these materials. The hardness of the outsole 2 is preferably set to, e.g., 50 A to 80 A (more preferably 60 A to 70 A) in a durometer C or A.

A plurality (three in the illustrated example) of outer wall portions 3 is provided at a peripheral edge portion located on the inner side of the outsole 2. The plurality of outer wall portions 3 stands upward from the peripheral edge portion located on the inner side of the outsole 2. The plurality of outer wall portions 3 is arranged at locations corresponding to the midfoot portion M and the hindfoot portion H of the wearer in the foot length direction. The plurality of outer wall portions 3 is arranged at intervals in the foot length direction. Each outer wall portion 3 is bonded to an outer surface side at a location corresponding at least to the hindfoot portion H of the wearer a lower midsole portion 8 which will be described later with an adhesive, for example (see FIG. 7).

(Midsole)

As illustrated in FIGS. 1 to 3, the sole structure 1 includes the midsole 4. The midsole 4 is configured to support a planta surface of the foot ft of the wearer. The midsole 4 is stacked on the upper side of the outsole 2, and is bonded thereto with an adhesive, for example. Note that in the shoe including the sole structure 1, an upper (not illustrated) for covering the foot ft of the wearer is provided at a peripheral edge (a peripheral edge of a later-described planta contact surface 9) of the midsole 4.

Figure 7:
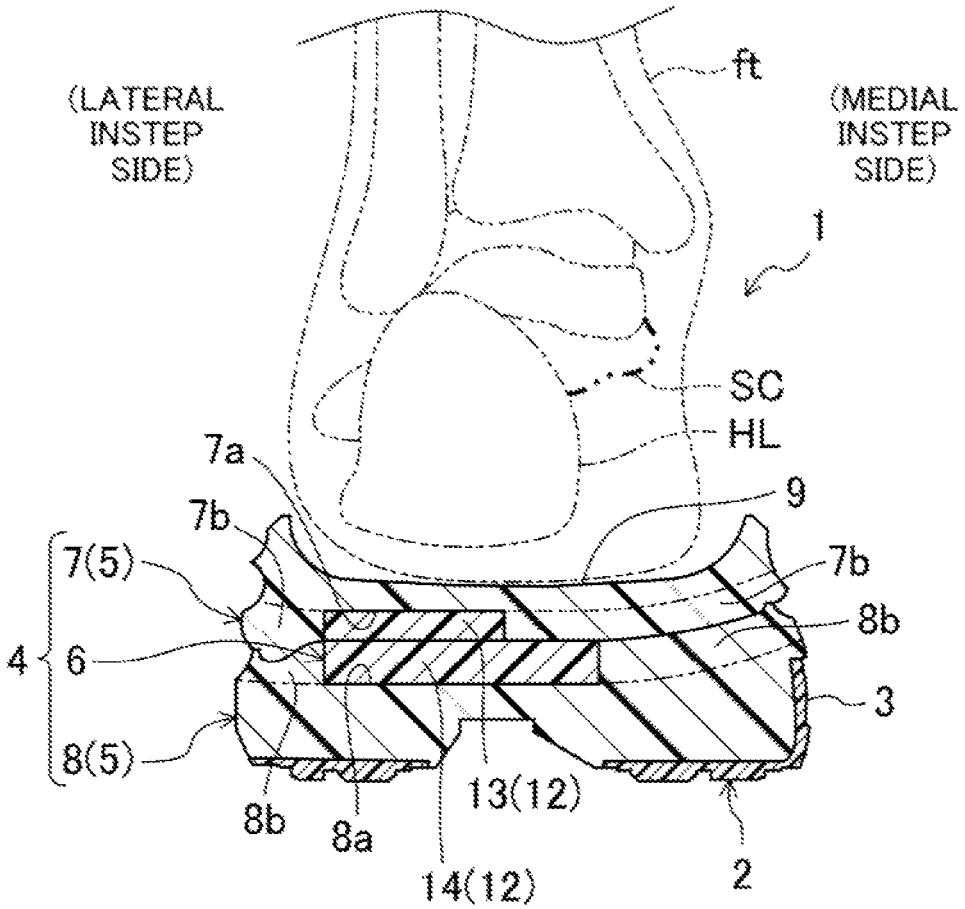
FIG. 7 is a cross-sectional view taken along line VII-VII illustrated in FIG. 3.

As illustrated in in FIGS. 1 to 3, the midsole 4 has a first midsole portion 5 and a second midsole portion 6. As illustrated in FIG. 7, in a cutting plane when the midsole 4 is cut along the foot width direction at a location corresponding to the sustentaculum tali SC of the foot ft of the wearer (hereinafter referred to as a "cutting plane"), the first midsole portion 5 and the second midsole portion 6 have a relatively-low hardness at a location corresponding to a tuber bottom portion of the calcaneus HL of the foot ft of the wearer, and a relatively-high hardness in an area ranging from the location corresponding to the sustentaculum tali SC of the wearer to a location corresponding to the navicular NB of the wearer. This is a characteristic configuration of the present disclosure.

Here, the above-described "sustentaculum tali SC" generally indicates a protrusion which is part of bones of a foot, is located on the front side of the foot with respect to the center of the calcaneus HL substantially in the foot length direction, and protrudes substantially horizontally inward in the foot width direction. In the following description, for the sake of convenience in description of each element of the sole structure 1, a portion excluding the "sustentaculum tali SC" will be referred to as the "calcaneus HL."

(First Midsole Portion)

As illustrated in FIGS. 1 to 3, the first midsole portion 5 is disposed at a location corresponding to the entire planta of the wearer in the sole structure 1. The first midsole portion 5 has an upper midsole portion 7 and a lower midsole portion 8.

The upper midsole portion 7 and the lower midsole portion 8 are made of soft elastic materials having a lower rigidity than the outsole 2. Specifically, examples of the materials suitable for the upper midsole portion 7 and the lower midsole portion 8 include thermoplastic synthetic resins such as an ethylene-vinyl acetate copolymer (EVA) and foams thereof, thermosetting resins such as polyurethane (PU) and foams thereof, and rubber such as butadiene rubber and chloroprene rubber and foams thereof.

The hardness of the upper midsole portion 7 and of the lower midsole portion 8 is preferably set within a range of 15 C to 65 C on an Asker C scale, for example. The hardness of the material forming the upper midsole portion 7 is different from that of the material forming the lower midsole portion 8. In this embodiment, the lower midsole portion 8 is made of a material having a higher hardness than the material forming the upper midsole portion 7.

The upper midsole portion 7 is disposed at a location corresponding to the entire planta of the wearer in the sole structure 1. The upper midsole portion 7 is disposed on a side on which the foot ft of the wearer is located (see FIG.

7). An upper surface of the upper midsole portion 7 serves as the planta contact surface 9 for supporting the planta surface of the wearer. The planta contact surface 9 has a curved shape such that the substantially center thereof in the foot width direction is recessed downward in a vertical sectional view (see FIG. 7).

Figure 4:
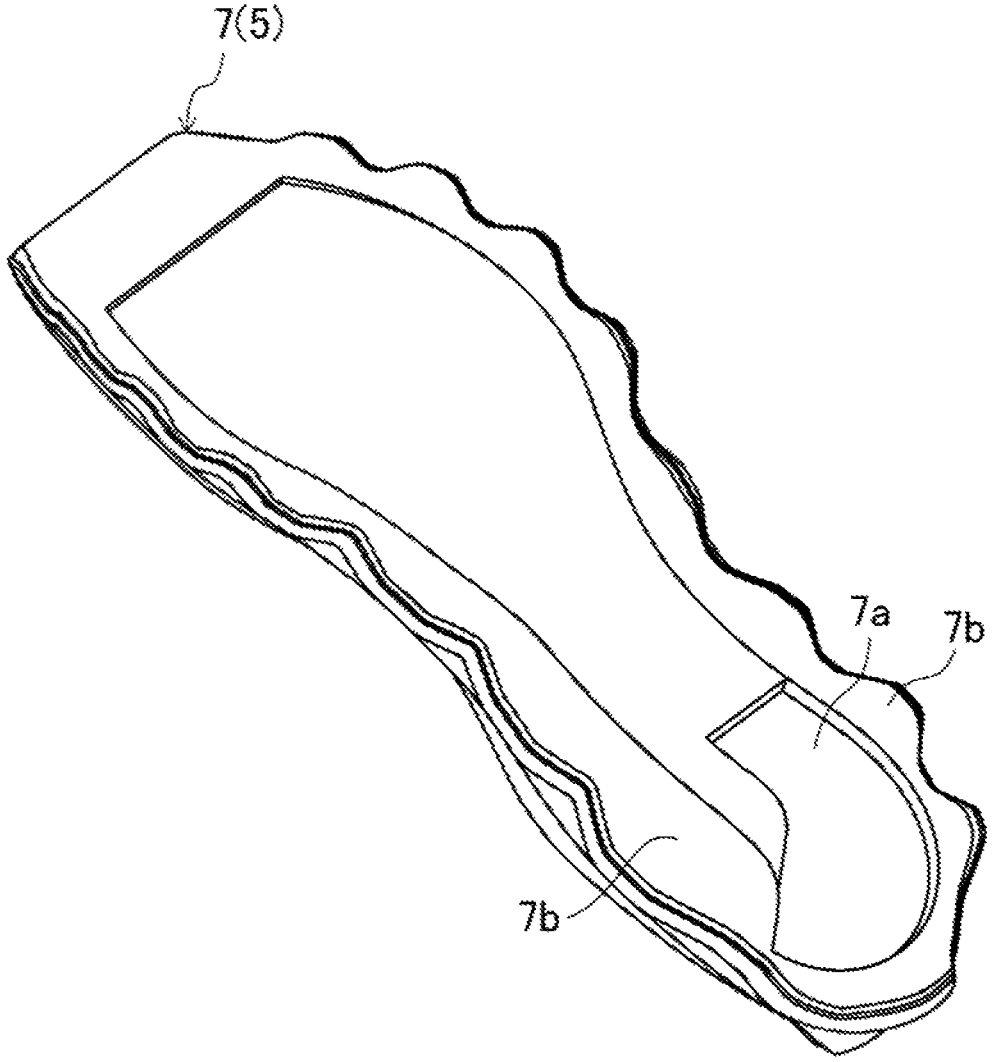
FIG. 4 is a perspective view illustrating an upper midsole portion from the bottom.

As illustrated in FIG. 4, the upper midsole portion 7 includes an upper recessed portion 7*a*. The upper recessed portion 7*a* is formed in a bottomed recessed shape as viewed from the bottom. Specifically, the upper recessed portion 7*a* is recessed upward (toward a side on which the planta contact surface 9 is located) from a lower portion of the upper midsole portion 7 (see FIGS. 6 and 7). The upper recessed portion 7*a* is formed in the area of the upper midsole portion 7 ranging from a location corresponding to the forefoot portion F to a location corresponding to the hindfoot portion H. The upper recessed portion 7*a* is deeper at a location (a location at which a later-described upper thin plate portion 13 is housed) corresponding to the hindfoot portion H than at other locations.

As illustrated in in FIG. 4, the upper midsole portion 7 includes upper peripheral wall portions 7*b*, 7*b*. The upper peripheral wall portions 7*b*, 7*b* are located on the inner and outer sides of the upper recessed portion 7*a* in the foot width direction. Each upper peripheral wall portion 7*b* is formed in a wall shape. Specifically, each upper peripheral wall portion 7*b* protrudes downward from a bottom surface side of the upper recessed portion 7*a* (see FIG. 7).

Each upper peripheral wall portion 7*b* is formed such that the protruding length thereof is not constant along the foot length direction as viewed from the side. Specifically, each upper peripheral wall portion 7*b* has such a wave shape that recessed and raised portions are alternately repeated along the foot length direction as viewed from the side.

As illustrated in in FIG. 7, in the above-described cutting plane, the wall thickness of the upper peripheral wall portion 7*b* in the foot width direction is larger on the inner side than on the outer side. That is, the upper peripheral wall portion 7*b* on the inner side is located in an area ranging from a location corresponding to the sustentaculum tali SC of the wearer to a location corresponding to the navicular NB of the wearer. On the other hand, the upper peripheral wall portion 7*b* on the outer side is located on the outer side of the calcaneus HL of the wearer. The upper peripheral wall portion 7*b* on the inner side is preferably disposed within an area ranging from a location corresponding to the sustentaculum tali SC of the wearer to a location corresponding to the navicular NB (see FIG. 3) of the wearer in the foot length direction. Note that in FIG. 7, the areas of the upper peripheral wall portions 7*b*, 7*b* are clearly indicated by the dash-dot-dot line.

As illustrated in FIGS. 1 to 3, the lower midsole portion 8 is disposed at a location corresponding to the entire planta of the wearer in the sole structure 1. The lower midsole portion 8 is disposed on a side on which the outsole 2 is located. As illustrated in FIG. 2, the lower midsole portion 8 is provided with a hole 10 penetrating a part of the lower midsole portion 8 in a thickness direction of the midsole 4 (hereinafter referred to as a "thickness direction"). Note that the hole 10 is not necessarily provided at the lower midsole portion 8.

Figure 5:
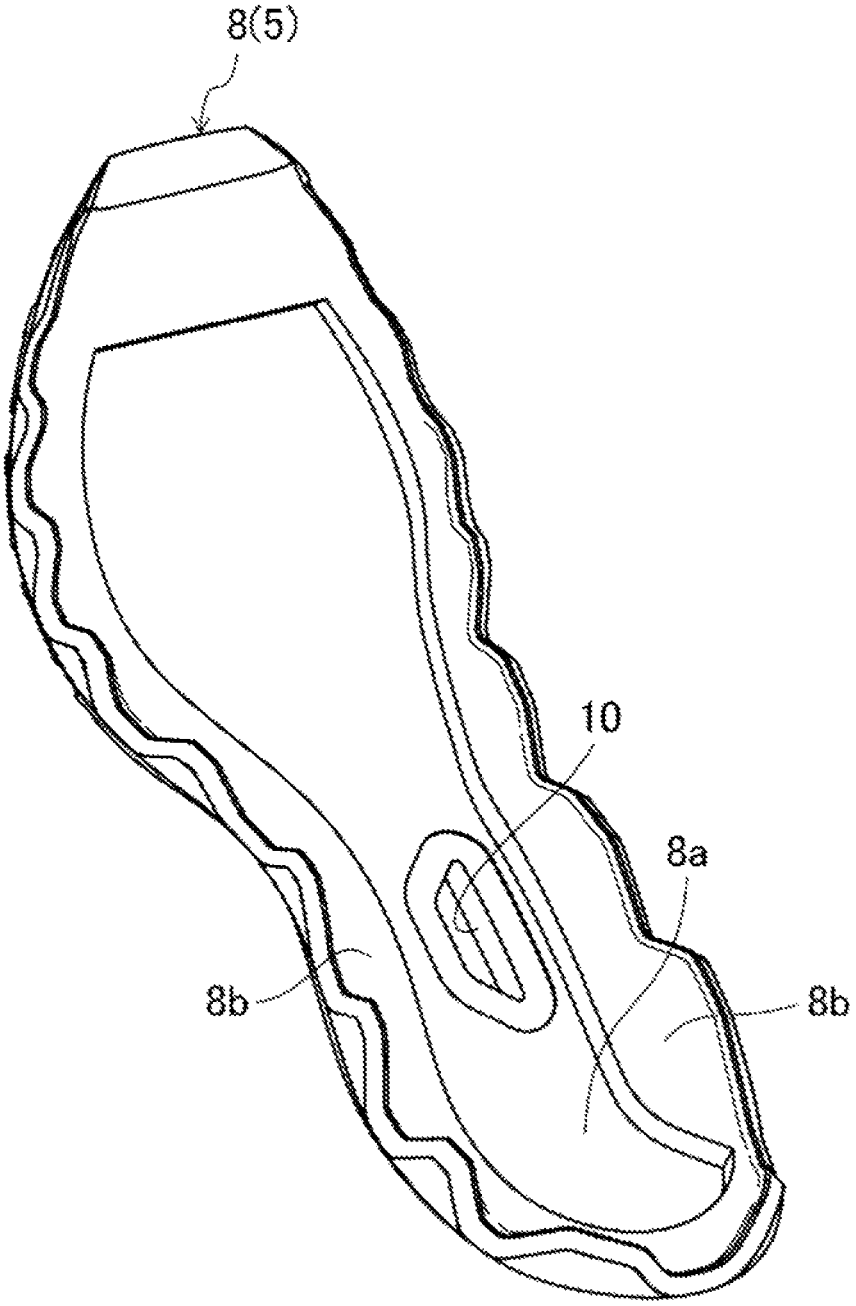
FIG. 5 is a perspective view illustrating a lower midsole portion in plane.

As illustrated in FIGS. 2 and 5, the lower midsole portion 8 includes a lower recessed portion 8*a*. The lower recessed portion 8*a* is formed in a bottomed recessed shape as viewed in plane. Specifically, the lower recessed portion 8*a* is recessed downward from an upper portion of the lower midsole portion 8 (recessed toward a side on which the outsole 2 is located) (see FIGS. 6 and 7).

The lower midsole portion 8 includes lower peripheral wall portions 8*b*, 8*b*. The lower peripheral wall portions 8*b*, 8*b* are located on the inner and outer sides of the lower recessed portion 8*a* in the foot width direction. Each lower peripheral wall portion 8*b* is formed in a wall shape. Specifically, each lower peripheral wall portion 8*b* protrudes upward from a bottom surface side of the lower recessed portion 8*a* (see FIG. 7).

Each lower peripheral wall portion 8*b* is formed such that the protruding length thereof is not constant along the foot length direction as viewed from the side. Specifically, each lower peripheral wall portion 8*b* has such a wave shape that recessed and raised portions are alternately repeated along the foot length direction as viewed from the side. Each lower peripheral wall portion 8*b* is formed such that the raised portions engage with the recessed portions of the upper peripheral wall portion 7*b* and the recessed portions engage with the raised portions of the upper peripheral wall portion 7*b*.

As illustrated in FIG. 7, in the above-described cutting plane, the wall thickness of the lower peripheral wall portion 8*b* in the foot width direction is larger on the inner side than on the outer side. That is, the lower peripheral wall portion 8*b* on the inner side is located in an area ranging from a location corresponding to the sustentaculum tali SC of the wearer to the inner side of a location corresponding to the sustentaculum tali SC. On the other hand, the lower peripheral wall portion 8*b* on the outer side is located on the outer side of the calcaneus HL of the wearer. Further, the lower peripheral wall portion 8*b* on the inner side is preferably disposed within an area ranging from a location corresponding to the sustentaculum tali SC of the wearer to a location corresponding to the navicular NB (see FIG. 3) of the wearer in the foot length direction. Note that in FIG. 7, the areas of the lower peripheral wall portions 8*b*, 8*b* are clearly indicated by the dash-dot-dot line.

Further, as illustrated in FIG. 7, in the above-described cutting plane, the lower peripheral wall portion 8*b* on the inner side has a longer protruding length than the upper peripheral wall portion 7*b* on the inner side. That is, in an area ranging from a location corresponding to the sustentaculum tali SC of the wearer to the navicular NB of the wearer in the above-described cutting plane, the proportion of the lower midsole portion 8 made of the material having a higher hardness than the material forming the upper midsole portion 7 is relatively high.

The first midsole portion 5 has a housing portion for housing the second midsole portion 6. In this embodiment, the housing portion forms a space surrounded by the upper recessed portion 7*a* and the lower recessed portion 8*a* in a state in which the upper midsole portion 7 and the lower midsole portion 8 are stacked on each other (see FIGS. 6 and 7). The housing portion is disposed corresponding to an area ranging from the forefoot portion F to the hindfoot portion H of the wearer in the first midsole portion 5.

(Second Midsole Portion)

As illustrated in FIGS. 2 and 3, the second midsole portion 6 is disposed at a location corresponding at least to the hindfoot portion H of the wearer. In this embodiment, the second midsole portion 6 is disposed in an area ranging from a location corresponding to the forefoot portion F of the wearer to a location corresponding to the hindfoot portion H of the wearer.

Figure 6:
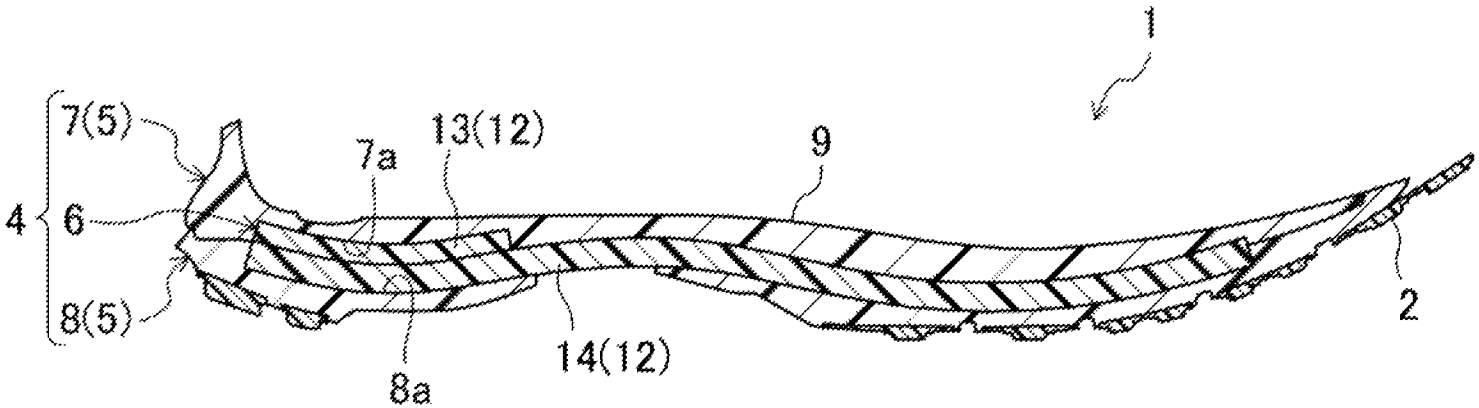
FIG. 6 is a cross-sectional view taken along line VI-VI illustrated in FIG. 3.

The second midsole portion 6 is made of a material having a lower hardness than the first midsole portion 5. The second midsole portion 6 has a hardness difference of 15 C or more on the Asker C scale as compared to the first midsole portion 5. Rubber foam is suitable as the material of the second midsole portion 6. As illustrated in FIGS. 6 and 7, the second midsole portion 6 is stacked on the first midsole portion 5 in the thickness direction. Specifically, while housed in the housing portion of the first midsole portion 5, the second midsole portion 6 is stacked between the upper midsole portion 7 and the lower midsole portion 8. The second midsole portion 6 may be fixed to each of the upper recessed portion 7*a* and the lower recessed portion 8*a* with an adhesive, for example.

As illustrated in FIG. 2, the second midsole portion 6 includes a plurality of thin plate portions 12. Each thin plate portion 12 has a thin plate shape. In this embodiment, the plurality of thin plate portions 12 are an upper thin plate portion 13 and a lower thin plate portion 14. The upper thin plate portion 13 is disposed on a side on which the upper midsole portion 7 is located. The lower thin plate portion 14 is disposed on a side on which the lower midsole portion 8 is located. The upper thin plate portion 13 is formed smaller than the lower thin plate portion 14. Particularly, in the foot width direction, the upper thin plate portion 13 has a shorter length than the lower thin plate portion 14.

As illustrated in FIGS. 2 and 3, the upper thin plate portion 13 is disposed in an area corresponding to the hindfoot portion H of the wearer in the foot length direction of the sole structure 1. Further, the upper thin plate portion 13 is disposed at a location avoiding a location corresponding to the sustentaculum tali SC of the wearer as viewed in plane. The lower thin plate portion 14 extends across an area from a location corresponding to the forefoot portion F of the wearer to the hindfoot portion H of the wearer in the foot length direction of the sole structure 1.

As illustrated in FIG. 7, in the above-described cutting plane, the upper thin plate portion 13 and the lower thin plate portion 14 are stacked such that the inner side portions thereof each form a step in the thickness direction. Moreover, in the above-described cutting plane, the second midsole portion 6 is relatively thick at a location corresponding to the calcaneus HL of the wearer and relatively thin in an area ranging from a location corresponding to the sustentaculum tali SC of the wearer to a location corresponding to the navicular NB of the wearer.

Advantages of First Embodiment

In general, a runner who prefers efficient running tends to require running shoes to have cushioning properties when the running shoes contact a ground or road surface during running (hereinafter referred to as "upon grounding"). Upon grounding, an impact (an initial impact) mainly in the vertical up-down direction is generated around a heel portion of a foot of a wearer (particularly, a bottom portion of a calcaneal tuber). The above-described impact is appropriately attenuated by the cushioning properties. On the other hand, a structure with higher cushioning properties tends to generate a phenomenon called pronation in which the calcaneus of the foot of the wearer falls inward after the grounding.

Here, the mechanism of the pronation will be specifically described. In general, a load (a body weight) on a foot during running is strongly applied to a sustentaculum tali mainly through a tibia and a talus. On the other hand, a ground-side fulcrum at this point is a bottom portion of a calcaneal tuber. Since the sustentaculum tali is a portion protruding inward of the center of a calcaneus, the calcaneus moves to fall inward of the sustentaculum tali as a starting point when the load during running is concentrated on the sustentaculum tali. Typically, the tension of a muscle group at the inner longitudinal arch of the foot supports such a falling calcaneus to reduce such falling movement. This appropriately attenuates the impact upon grounding. However, an insufficient tension of the muscle group at the inner longitudinal arch or inappropriate arrangement (so-called skeletal alignment) of bones and joints of the foot generates movement called overpronation in which the calcaneus falls excessively. Due to the structure of the foot joints, such overpronation also causes inner rotation of a lower leg at the same time as the falling movement of the calcaneus. As a result, excessive stress is also on muscles and ligaments in the vicinity of a knee joint and/or in the vicinity of a hip joint. That is, when the overpronation occurs, a load is on various portions of the lower leg linked to the calcaneus, and a running disorder accompanied by chronic pain may occur at these portions. As described above, the sustentaculum tali serves as the starting point at which the pronation occurs. For reducing the above-described overpronation, it is important to stably support the sustentaculum tali during running.

Based on such findings, the sole structure 1 of the first embodiment of the present disclosure can provide the following advantages. That is, in the above-described cutting plane, the first midsole portion 5 and the second midsole portion 6 have a relatively-low hardness at the locations corresponding to the calcaneus HL of the wearer. Such a configuration improves the cushioning properties at the locations corresponding to the calcaneus HL of the wearer at the first midsole portion 5 and the second midsole portion 6. Such cushioning properties, when the sole structure 1 contacts a ground or road surface during running (upon grounding), attenuate an impact on the heel portion (the calcaneus HL) of the wearer particularly upon grounding. On the other hand, in the above-described cutting plane, the first midsole portion 5 and the second midsole portion 6 have a relatively-high hardness in the area ranging from the location corresponding to the sustentaculum tali SC of the wearer to the location corresponding to the navicular NB of the wearer. Such a configuration relatively enhances rigidity though degrades the cushioning properties in the area ranging from the location corresponding to the sustentaculum tali SC of the wearer to the location corresponding to the navicular NB of the wearer at the first midsole portion 5 and the second midsole portion 6. Such rigidity improves supporting properties particularly at the location of the sustentaculum tali SC of the wearer. Specifically, the first midsole portion 5 and the second midsole portion 6 stably support the location of the sustentaculum tali SC of the wearer. This reduces occurrence of a phenomenon (so-called overpronation) in which the heel portion becomes instable and excessively falls inward after grounding. As described above, in the sole structure 1, the cushioning properties appropriately attenuate impact on the heel portion of the wearer while the supporting properties reduce occurrence of the overpronation. Accordingly, the sole structure 1 of the first embodiment of the present disclosure can achieve a favorable feeling particularly during running.

In the above-described cutting plane, the plurality of thin plate portions 12 forming the second midsole portion 6 is stacked such that the inner side portions of the thin plate portions 12 each form a step in the thickness direction. Moreover, in the above-described cutting plane, the second midsole portion 6 is relatively thick at a location corresponding to the calcaneus HL of the wearer and relatively thin in an area ranging from a location corresponding to the sustentaculum tali SC of the wearer to a location corresponding to the navicular NB of the wearer. Such a configuration relatively increases the proportion of the second midsole portion 6 at the location corresponding to the calcaneus HL of the wearer in the above-described cutting plane, thus improving the cushioning properties. On the other hand, in the above-described cutting plane, the proportion of the first midsole portion 5 relatively increases in the area ranging from the location corresponding to the sustentaculum tali SC of the wearer to the location corresponding to the navicular NB of the wearer. This relatively enhances the rigidity though relatively degrades the cushioning properties. Therefore, as described above, in the sole structure 1, the cushioning properties and the repulsive force appropriately attenuate the impact on the heel portion (the calcaneus HL) of the wearer while the supporting properties reduce occurrence of the overpronation.

The second midsole portion 6 is housed in the housing portion surrounded by the upper recessed portion 7*a* and the lower recessed portion 8*a*. That is, the second midsole portion 6 is housed in the internal space of the first midsole portion 5 (the upper midsole portion 7 and the lower midsole portion 8). Such a configuration enables the entire upper surface of the upper midsole portion 7 to serve as the planta contact surface 9, and disallows a boundary portion between the first midsole portion 5 and the second midsole portion 6 to contact the planta of the wearer. This does not cause an uncomfortable feeling of the planta of the wearer due to a hardness difference at the boundary portion. Also, the above-described configuration enables the entire lower surface of the lower midsole portion 8 to serve as a grounding-side surface (a surface stacked on the outsole 2), and does not cause an uncomfortable feeling upon grounding due to the hardness difference at the boundary portion. Accordingly, the sole structure 1 can achieve a favorable feeling particularly during running.

Further, in the above-described cutting plane, the wall thickness of the upper peripheral wall portion 7*b* in the foot width direction is larger on the inner side than on the outer side. Similarly, in the above-described cutting plane, the wall thickness of the lower peripheral wall portion 8*b* in the foot width direction is larger on the inner side than on the outer side. Such a configuration relatively increases the proportion of the second midsole portion 6 at the location corresponding to the calcaneus HL of the wearer in the above-described cutting plane, thus improving the cushioning properties. On the other hand, in the above-described cutting plane, the proportion of the first midsole portion 5 relatively increases in the area ranging from the location corresponding to the sustentaculum tali SC of the wearer to the location corresponding to the navicular NB of the wearer. This relatively enhances the rigidity though relatively degrades the cushioning properties. Therefore, as described above, in the sole structure 1, the cushioning properties appropriately attenuate the impact on the heel portion (the calcaneus HL) of the wearer while the supporting properties reduce occurrence of the overpronation.

The lower midsole portion 8 is made of the material having a higher hardness than the material forming the upper midsole portion 7. In the above-described cutting plane, the lower peripheral wall portion 8*b* on the inner side has a longer protruding length than the upper peripheral wall portion 7*b* on the inner side. In the above-described cutting plane, such a configuration relatively increases the proportion of the lower midsole portion 8 in the area ranging from the location corresponding to the sustentaculum tali SC of the wearer to the inner side, thus relatively enhancing the rigidity. This can further improve the supporting properties to reduce occurrence of the overpronation, as described above.

The outer wall portion 3 of the outsole 2 is disposed on the outer surface side of the lower midsole portion 8 at the location corresponding at least to the hindfoot portion H of the wearer. This outer wall portion 3 enables reduction in compressive deformation of an inner region of the lower midsole portion 8 due to the impact upon grounding, for example, which results in improving the supporting properties of the lower midsole portion 8 on the inner side to reduce occurrence of the overpronation.

The second midsole portion 6 has a hardness difference of 15 C or more on the Asker C scale as compared to the first midsole portion 5. This hardness difference can further clarify a difference between the cushioning properties at the location corresponding to the calcaneus HL of the wearer and the supporting properties in the area ranging from the location corresponding to the sustentaculum tali SC of the wearer to the location corresponding to the navicular NB of the wearer.

The second midsole portion 6 is made of the rubber foam. That is, the rubber foam having a low hardness and a high repulsive force is used for the second midsole portion 6. This can achieve propulsion during running while appropriately attenuating the impact on the heel portion (the calcaneus HL) of the wearer. Also, the rubber foam enables relatively easy manufacturing of the second midsole portion 6.

First Variation of First Embodiment

In the first embodiment, the lower midsole portion 8 is made of the material having a higher hardness than the material forming the upper midsole portion 7, and in the cutting plane, the lower peripheral wall portion 8*b* on the inner side has a longer protruding length than the upper peripheral wall portion 7*b* on the inner side. However, this is merely a non-limiting example. That is, although not illustrated in the figure, the upper midsole portion 7 may be made of a material having a higher hardness than the material forming the lower midsole portion 8, and in the cutting plane, the upper peripheral wall portion 7*b* on the inner side may have a longer protruding length than the lower peripheral wall portion 8*b* on the inner side. This configuration also relatively enhances the rigidity in the area ranging from the location corresponding to the sustentaculum tali SC of the wearer to the location corresponding to the navicular NB of the wearer, which results in improving the supporting properties to reduce occurrence of the overpronation.

Second Variation of First Embodiment

In the first embodiment, the upper recessed portion 7*a* of the upper midsole portion 7 and the lower recessed portion 8*a* of the lower midsole portion 8 form the housing portion for housing the second midsole portion 6. However, this is merely a non-limiting example. Alternatively, though not illustrated in the figure, no lower recessed portion 8*a* may be provided at the lower midsole portion 8 and the housing portion may be formed only by the upper recessed portion 7*a* of the upper midsole portion 7, or no upper recessed portion 7*a* may be provided at the upper midsole portion 7 and the housing portion may be formed only by the lower recessed portion 8*a* of the lower midsole portion 8. That is, it may only be required that the recessed portion formed at least at one of the upper midsole portion 7 or the lower midsole portion 8 is surrounded by the peripheral wall portion formed at least at one of the upper midsole portion 7 or the lower midsole portion 8 and forms the housing portion. In this case, the wall thickness of the peripheral wall portion formed at least at one of the upper midsole portion 7 or the lower midsole portion 8 is larger on the inner side of the recessed portion in the foot width direction than on the outer side of the recessed portion in the foot width direction.

Second Embodiment

FIGS. 8 to 11 illustrate a sole structure 1 of a second embodiment of the present disclosure. The second embodiment is different from the first embodiment mainly in the configurations of a first midsole portion 5 and a second midsole portion 6. Note that other configurations of the sole structure 1 of the second embodiment are similar to the configurations of the sole structure 1 of the first embodiment. Thus, the same reference signs are used to represent the same elements as those illustrated in FIGS. 1 to 7, and detailed description thereof will be omitted.

As illustrated in FIGS. 8 to 11, the sole structure 1 of the second embodiment includes an outsole 2. The outsole 2 is disposed corresponding to an area ranging from a forefoot portion F to a hindfoot portion H of a wearer. Note that in this embodiment, the plurality of outer wall portions 3 described in the first embodiment is not provided at a peripheral edge portion located on the inner side of the outsole 2.

The first midsole portion 5 of the second embodiment is not separated into the upper midsole portion 7 and the lower midsole portion 8 described in the first embodiment, but is formed as a single member.

The first midsole portion 5 is disposed at a location corresponding to the entire planta of the wearer in the sole structure 1. An upper surface of the first midsole portion 5 serves as a planta contact surface 9 for supporting the planta of the wearer. The outsole 2 is stacked on a lower surface of the first midsole portion 5.

The first midsole portion 5 includes a housing portion 11 for housing the second midsole portion 6. In the second embodiment, the housing portion 11 is, at the first midsole portion 5, disposed corresponding to an area ranging from a midfoot portion M to the hindfoot portion H of the wearer.

The housing portion 11 is formed in a bottomed recessed shape as viewed in plane, and opens upward of the first midsole portion 5. Specifically, the housing portion 11 is recessed downward from the planta contact surface 9 (an upper portion of the first midsole portion 5).

A step surface 20 is formed at a front portion of the housing portion 11. The step surface 20 is formed in a step shape extending downward from the planta contact surface 9 as viewed in a section. Moreover, the step surface 20 is formed to approach a location corresponding to the hindfoot portion H of the wearer from a location corresponding to the midfoot portion M of the wearer as extending from the outer side to the inner side as viewed in plane.

The first midsole portion 5 includes wall-shaped peripheral wall portions 21, 21 serving as inner wall surfaces of the housing portion 11. Each peripheral wall portion 21 is located on the inner and outer sides of the housing portion 11 in the foot width direction.

Figure 11:
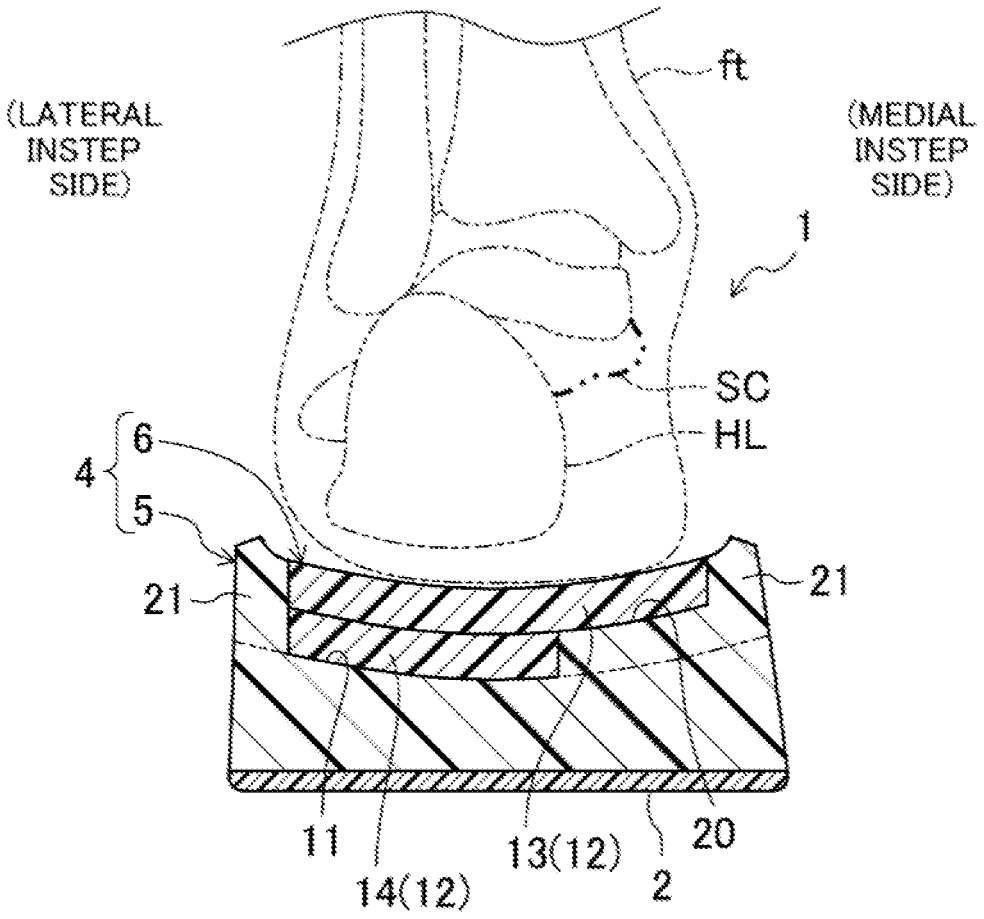
FIG. 11 is a cross-sectional view taken along line XI-XI illustrated in FIG. 8.

As illustrated in FIG. 11, in the above-described cutting plane, the wall thickness of the peripheral wall portion 21 in the foot width direction is larger on the inner side than the outer side. That is, the peripheral wall portion 21 located on the inner side is located in an area ranging from a location corresponding to the sustentaculum tali SC of the wearer to a location corresponding to the navicular NB of the wearer, and on the other hand, the peripheral wall portion 21 located on the outer side is located on the outer side of the calcaneus HL of the wearer. Note that in FIG. 11, the areas of the peripheral wall portions 21, 21 are clearly indicated by the dash-dot-dot line.

Figure 8:
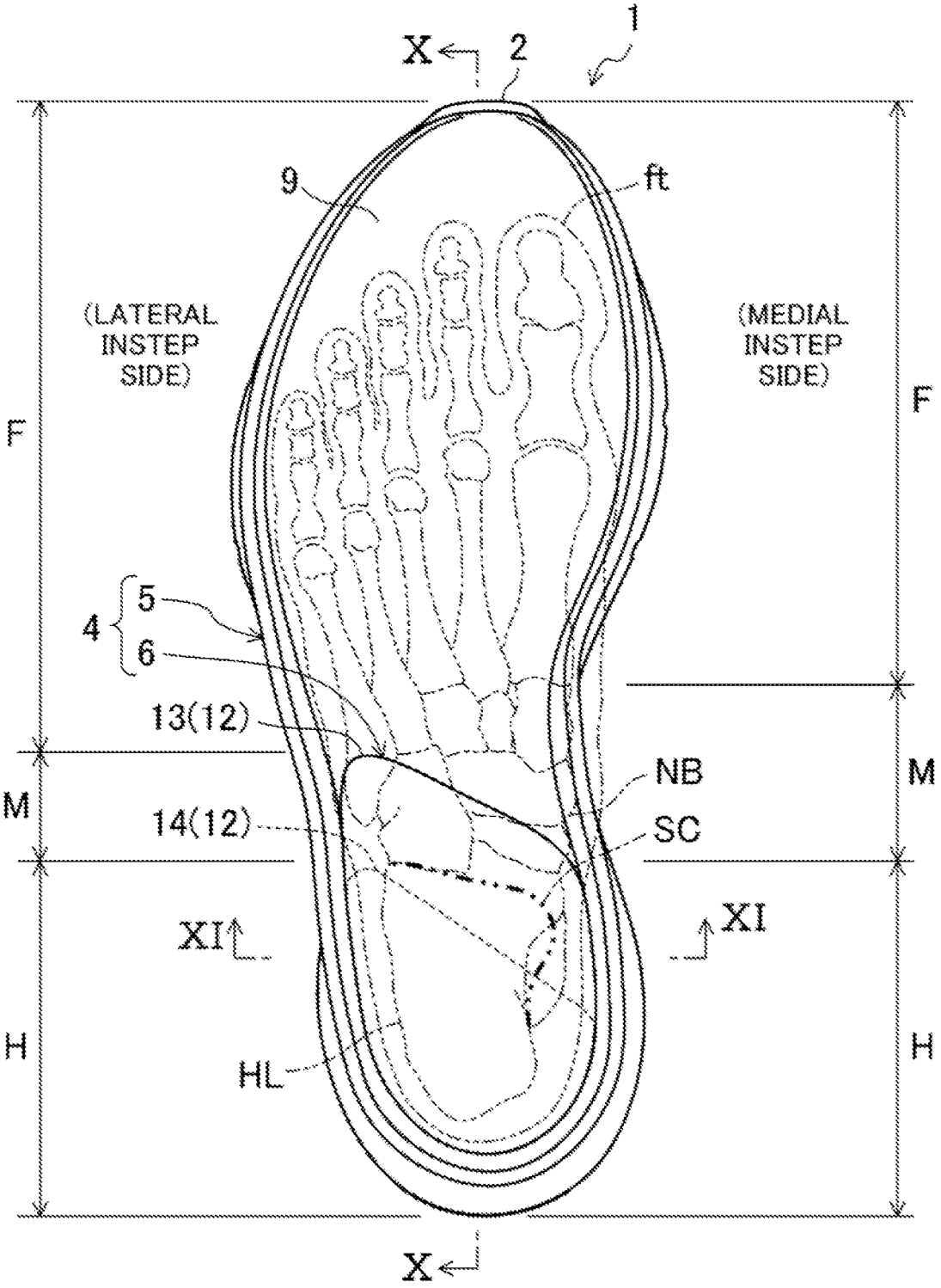
FIG. 8 is a top view virtually illustrating a state in which a skeletal structure of a foot of a wearer is on a sole structure of a second embodiment.
Figure 9:
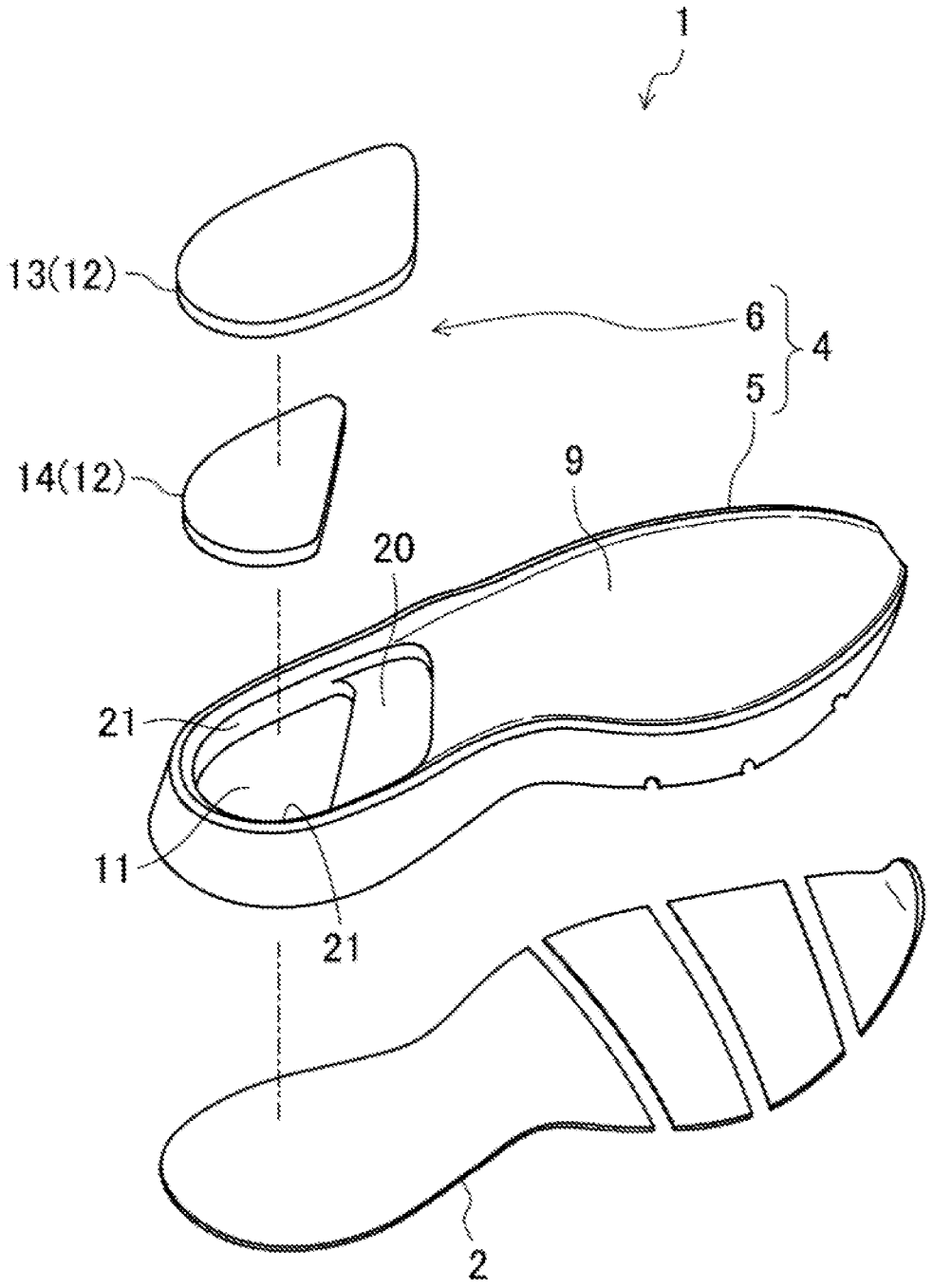
FIG. 9 is an exploded perspective view illustrating each configuration of the sole structure of the second embodiment.

As illustrated in FIG. 8, the second midsole portion 6 is disposed in an area ranging from a location corresponding to the midfoot portion M of the wearer to a location corresponding to the hindfoot portion H of the wearer. The second midsole portion 6 is made of a material (e.g., rubber foam) having a lower hardness than the first midsole portion 5.

Figure 10:
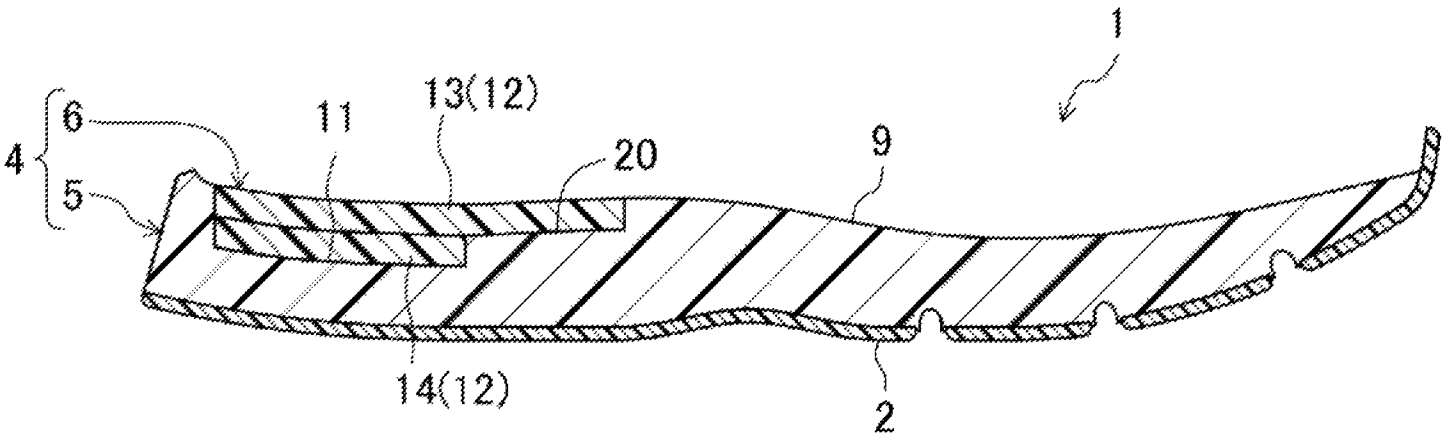
FIG. 10 is a cross-sectional view taken along line X-X illustrated in FIG. 8.

As illustrated in FIGS. 10 and 11, the second midsole portion 6 is stacked on the first midsole portion 5 in the thickness direction. Specifically, the second midsole portion 6 is stacked on the first midsole portion 5 in a state in which the second midsole portion 6 is housed in the housing portion 11 of the first midsole portion 5. The second midsole portion 6 may be fixed to the housing portion 11 with an adhesive, for example.

As illustrated in FIGS. 8 to 11, the second midsole portion 6 includes a plurality of thin plate portions 12 (an upper thin plate portion 13 and a lower thin plate portion 14). The upper thin plate portion 13 is formed larger than the lower thin plate portion 14.

Each front end portion of the upper thin plate portion 13 and the lower thin plate portion 14 is inclined rearward from the outer side to the inner side as viewed in plane (see FIG. 8). The front end portion of the upper thin plate portion 13 and the front end portion of the lower thin plate portion 14 are substantially parallel to each other as viewed in plane.

In this embodiment, the lower thin plate portion 14 is disposed on the bottom side of the housing portion 11. The upper thin plate portion 13 is stacked on the upper side of the lower thin plate portion 14, and is disposed on the step surface 20 of the housing portion 11. An upper surface of the upper thin plate portion 13 is substantially flush with the planta contact surface 9 when the upper thin plate portion 13 is housed in the housing portion 11.

The upper thin plate portion 13 is disposed across an area from a location corresponding to the midfoot portion M of the wearer to a location corresponding to the hindfoot portion H of the wearer in the foot length direction of the sole structure 1. The lower thin plate portion 14 is disposed in an area corresponding to the hindfoot portion H of the wearer in the foot length direction of the sole structure 1.

As illustrated in FIG. 11, in the above-described cutting plane, the upper thin plate portion 13 and the lower thin plate portion 14 are stacked such that inner side portions of the upper thin plate portion 13 and the lower thin plate portion 14 each form a step in the thickness direction. Moreover, in the above-described cutting plane, the second midsole portion 6 is relatively thick at a location corresponding to the calcaneus HL of the wearer and relatively thin in an area ranging from a location corresponding to the sustentaculum tali SC of the wearer to a location corresponding to the navicular NB of the wearer. Such a configuration obtains advantages similar to those of the first embodiment.

Advantages of Second Embodiment

In the second embodiment, in the above-described cutting plane (see FIG. 11), the first midsole portion 5 and the second midsole portion 6 have a relatively-low hardness at the location corresponding to the calcaneus HL of the wearer, and a relatively-high hardness in the area ranging from the location corresponding to the sustentaculum tali SC of the wearer to the location corresponding to the navicular NB of the wearer. With this configuration, cushioning properties appropriately attenuate an impact on a heel portion (the calcaneus HL) of the wearer while the supporting properties reduce occurrence of the overpronation, as in the first embodiment. Therefore, even the sole structure 1 of the second embodiment of the present disclosure can achieve a favorable feeling particularly during running.

The second midsole portion 6 is stacked on the first midsole portion 5 in a state in which the second midsole portion 6 is housed in the housing portion 11 of the first midsole portion 5. Particularly, in the second embodiment, the second midsole portion 6 is housed in the housing portion 11 opening upward. Thus, the second midsole portion 6 made of the material having a lower hardness than the first midsole portion 5 is easily brought into contact with the location corresponding to the calcaneus HL of the wearer. This can relatively enhance the cushioning properties to further attenuate the impact on the heel portion of the wearer. Further, in this variation, the entire lower surface of the first midsole portion 5 serves as a grounding-side surface (a surface stacked on the outsole 2). This does not cause an uncomfortable feeling upon grounding due to a hardness difference at the above-described boundary portion.

In the above-described cutting plane (see FIG. 11), the wall thickness of the peripheral wall portion 21 in the foot width direction is larger on the inner side than the outer side. Such a configuration relatively increases the proportion of the second midsole portion 6 at the location corresponding to the calcaneus HL of the wearer to improve the cushioning properties. On the other hand, in the area ranging from the location corresponding to the sustentaculum tali SC of the wearer to the location corresponding to the navicular NB of the wearer, the proportion of the first midsole portion 5 relatively increases. This relatively enhances the rigidity though relatively degrades the cushioning properties. Thus, in the sole structure 1 of the second embodiment, cushioning properties appropriately attenuate an impact on a heel portion (the calcaneus HL) of the wearer while the supporting properties reduce occurrence of the overpronation.

First Variation of Second Embodiment

In the second embodiment, the housing portion 11 opens upward of the first midsole portion 5. However, this is merely a non-limiting example. For example, it may be configured as in a first variation illustrated in FIGS. 12 to 16. Hereinafter, differences of the first variation from the second embodiment will be mainly described.

Figure 12:
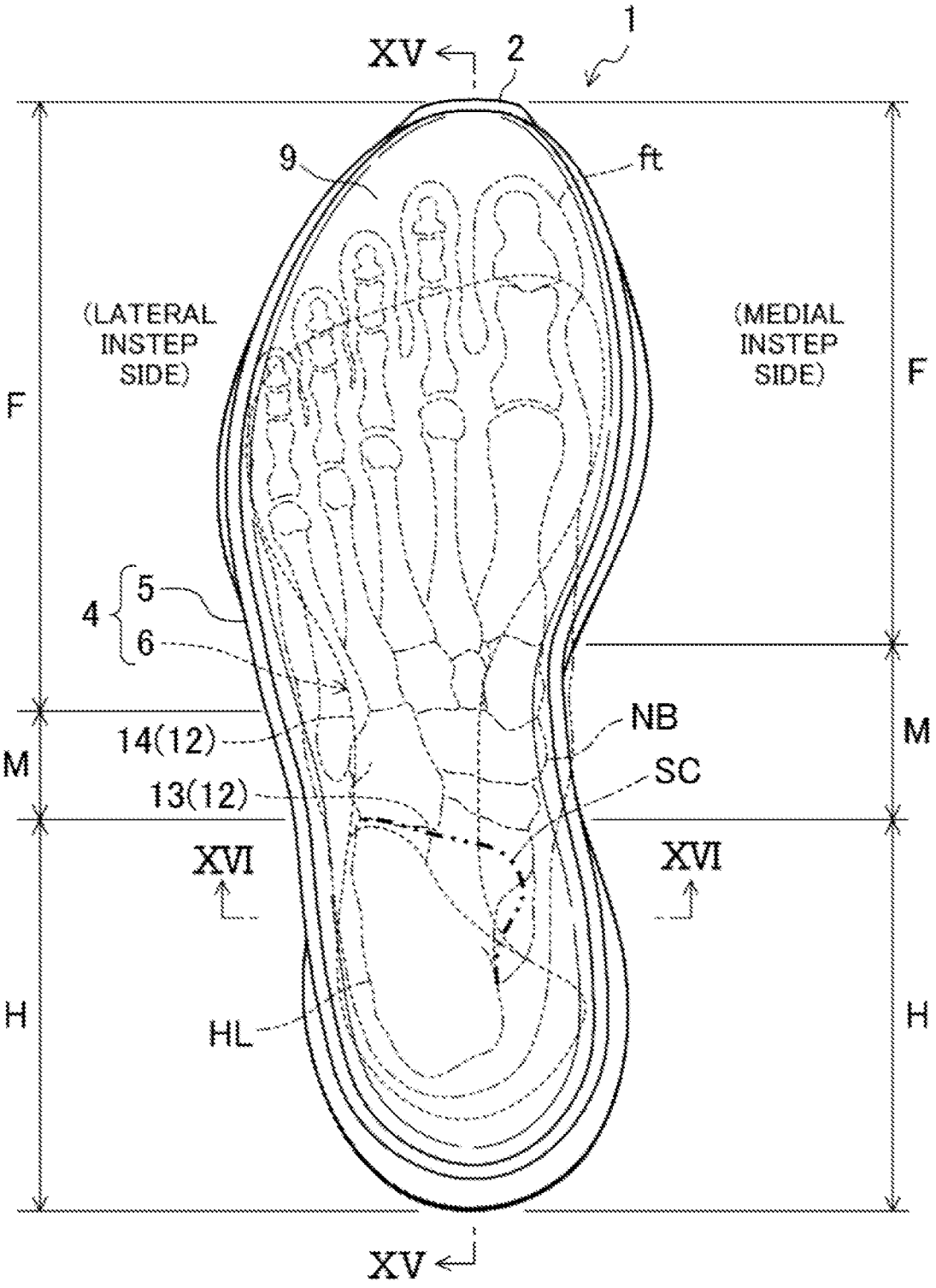
FIG. 12 is a top view virtually illustrating a state in which a skeletal structure of a foot of a wearer is on a sole structure of a first variation of the second embodiment.
Figure 14:
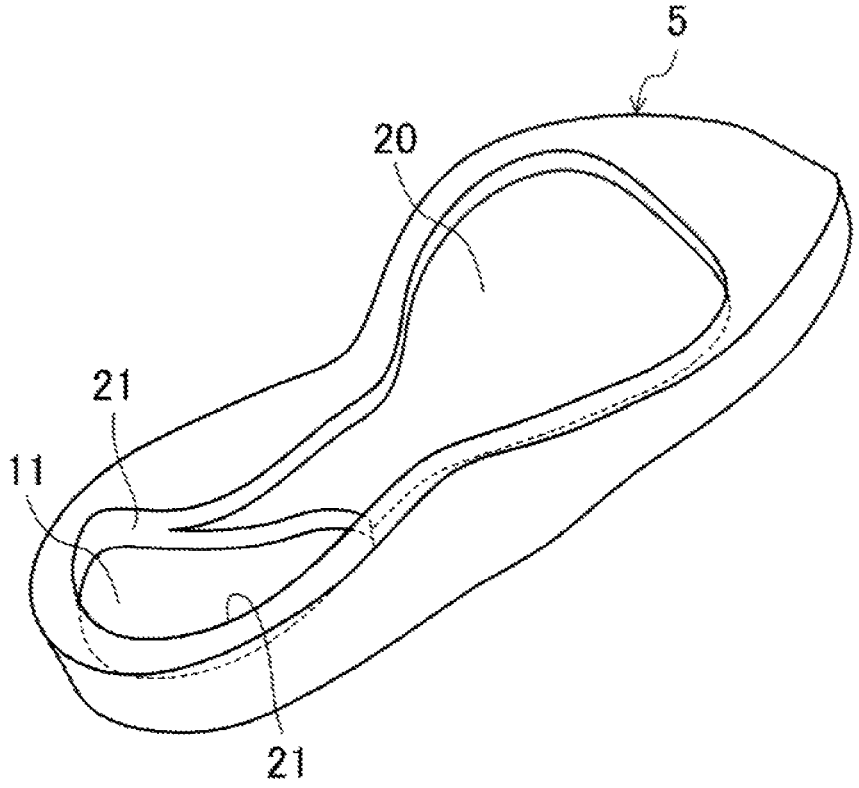
FIG. 14 is a perspective view illustrating a first midsole portion from the bottom.

As illustrated in FIG. 12, in the first variation, the housing portion 11 is disposed corresponding to an area ranging from the forefoot portion F to the hindfoot portion H of the wearer at the first midsole portion 5. As illustrated in FIG. 14, the housing portion 11 is formed in a bottomed recessed shape as viewed from the bottom, and opens downward of the first midsole portion 5. Specifically, the housing portion 11 is recessed upward from a lower portion (a lower surface) of the first midsole portion 5.

Figure 15:
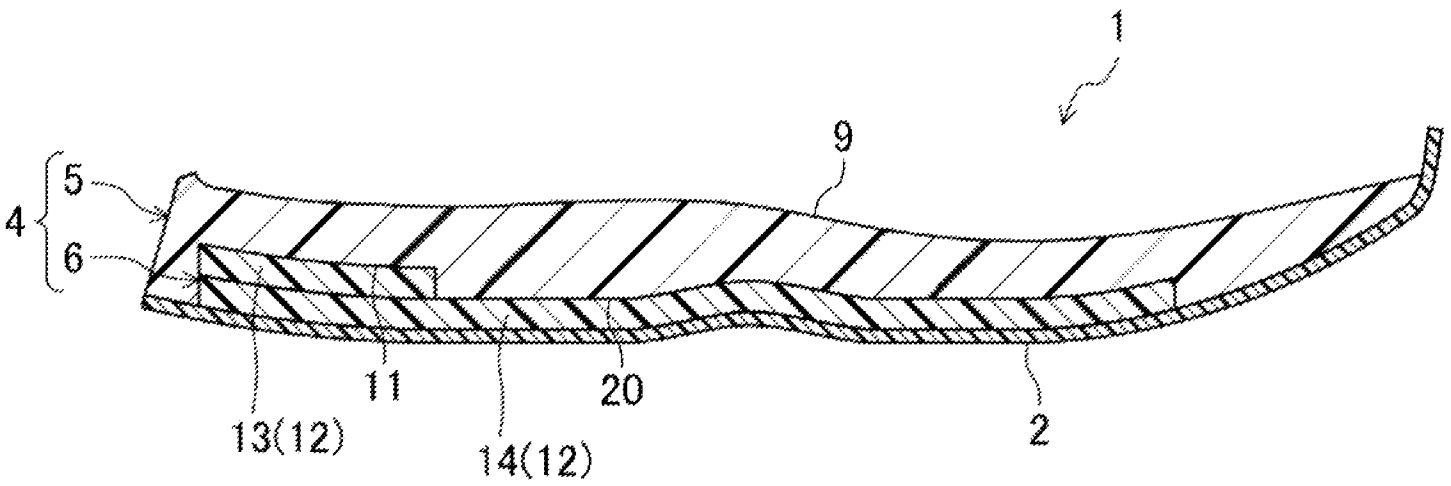
FIG. 15 is a cross-sectional view taken along line XV-XV illustrated in FIG. 12.
Figure 16:
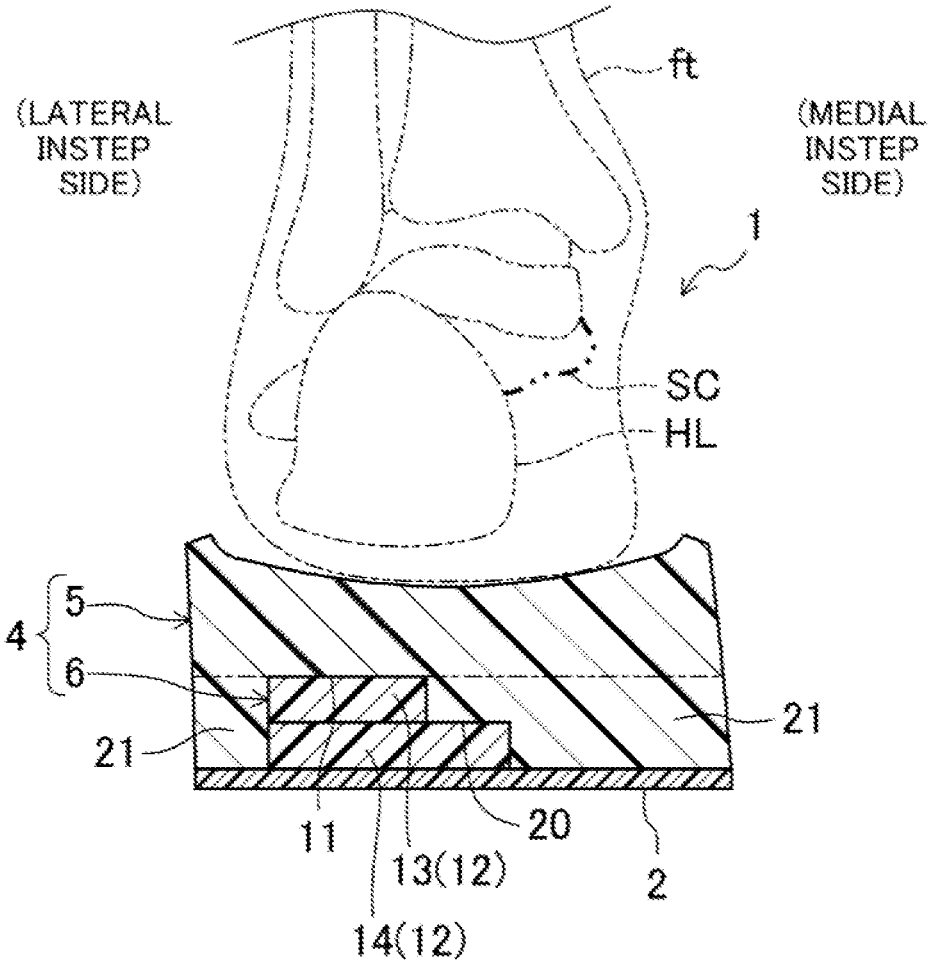
FIG. 16 is a cross-sectional view taken along line XVI-XVI illustrated in FIG. 8.
Figure 17:
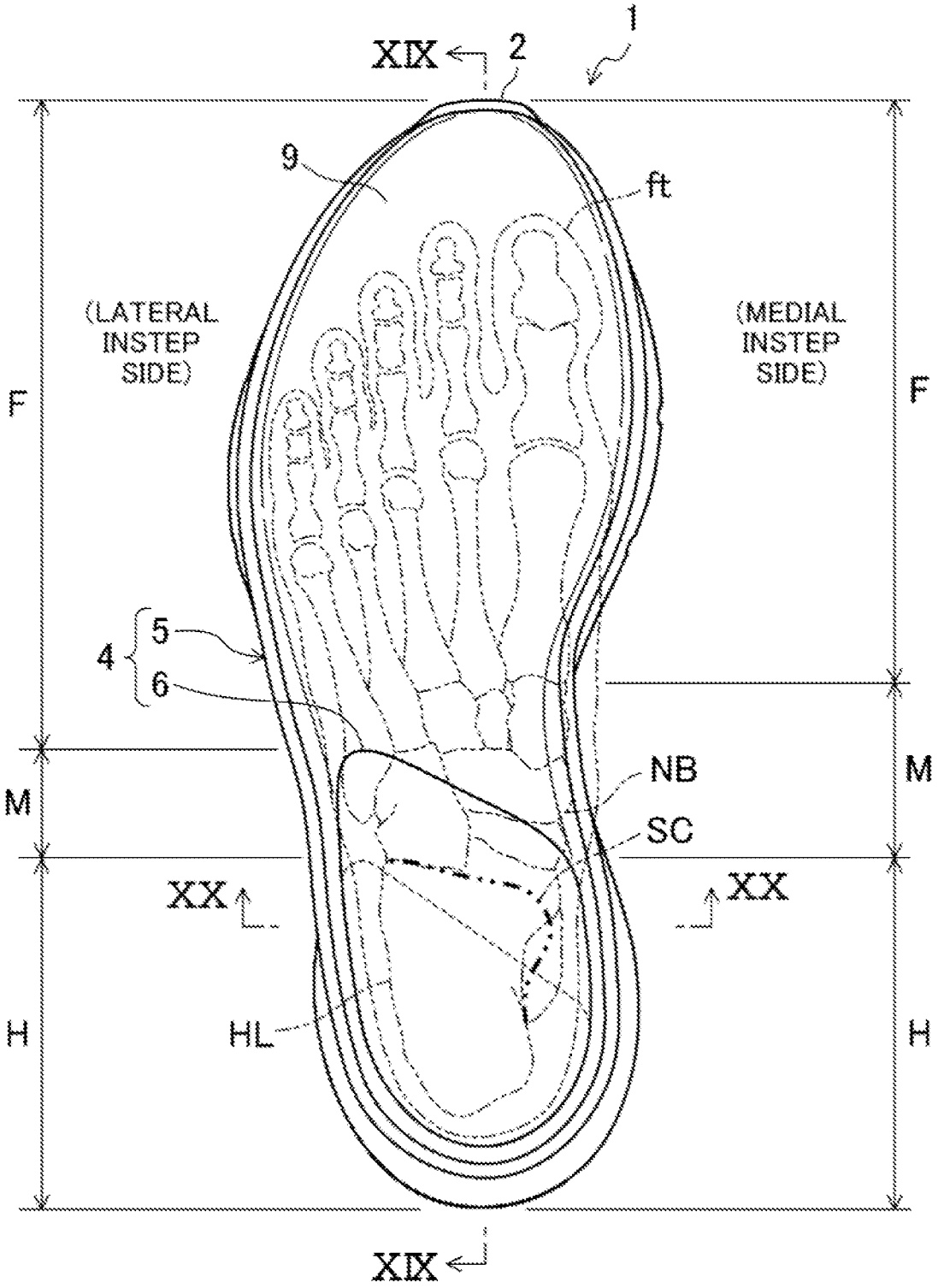
FIG. 17 is a top view virtually illustrating a state in which a skeletal structure of a foot of a wearer is on the sole structure of the second variation of the second embodiment.

As illustrated in FIGS. 14 to 16, the step surface 20 is formed in a shape stepped downward from the lower surface of the first midsole portion 5 as viewed in a section. The peripheral wall portions 21, 21 are, at the location of lower ends thereof, formed substantially flush with the lower surface of the first midsole portion 5 as in viewed in a section.

As illustrated in FIG. 12, the second midsole portion 6 is disposed in an area ranging from a location corresponding to the forefoot portion F of the wearer to a location corresponding to the hindfoot portion H of the wearer.

Figure 13:
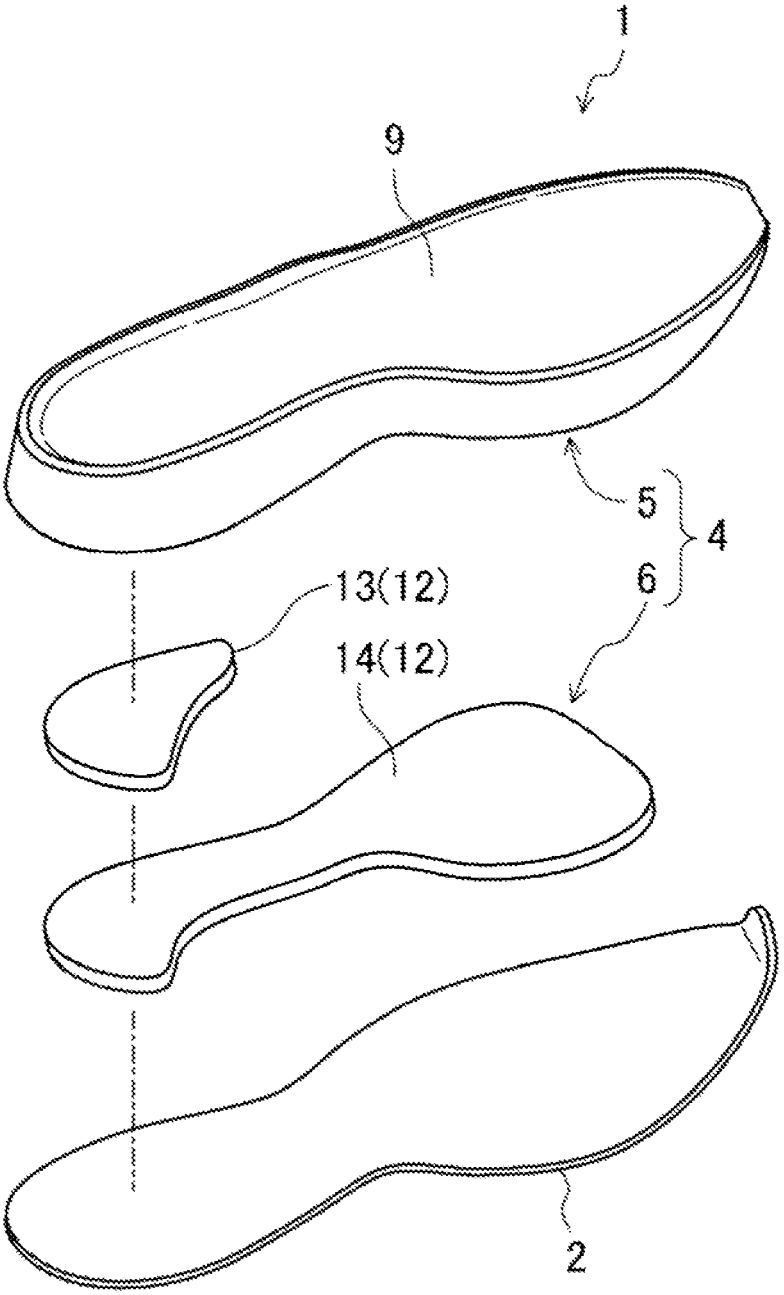
FIG. 13 is an exploded perspective view illustrating each configuration of a sole structure of a second variation of the second embodiment.

As illustrated in FIGS. 12 and 13, the upper thin plate portion 13 is formed smaller than the lower thin plate portion 14. The upper thin plate portion 13 is disposed in an area corresponding to the hindfoot portion H of the wearer in the foot length direction of the sole structure 1. The upper thin plate portion 13 is disposed at a location avoiding a location corresponding to the sustentaculum tali SC of the wearer as viewed in plane. As illustrated in FIGS. 15 and 16, the upper thin plate portion 13 is disposed on the bottom side of the housing portion 11.

As illustrated in FIGS. 12 and 13, the lower thin plate portion 14 extends across an area from a location corresponding to the forefoot portion F of the wearer to a location corresponding to the hindfoot portion H of the wearer in the foot length direction of the sole structure 1. As illustrated in FIGS. 15 and 16, the lower thin plate portion 14 is stacked on the lower side of the upper thin plate portion 13, and is disposed on the step surface 20 of the housing portion 11. A lower surface of the lower thin plate portion 14 is substantially flush with a lower surface of the first midsole portion 5 in a state in which the lower thin plate portion 14 is housed in the housing portion 11.

In this variation, the second midsole portion 6 is stacked on the first midsole portion 5 while housed in the housing portion 11 of the first midsole portion 5. Particularly, in this variation, the second midsole portion 6 is housed in the housing portion 11 opening downward. Thus, the entire upper surface of the first midsole portion 5 can serve as the planta contact surface 9, and a boundary portion between the first midsole portion 5 and the second midsole portion 6 does not contact the planta of the wearer. This does not cause an uncomfortable feeling of the sole of the wearer due to a hardness difference at the boundary portion.

Second Variation of Second Embodiment

In the second embodiment, the step surface 20 is formed at the front portion of the housing portion 11, and the second midsole portion 6 includes the plurality of thin plate portions 12 (the upper thin plate portion 13 and the lower thin plate portion 14). However, this is merely a non-limiting example. For example, it may be configured as in a second variation illustrated in FIGS. 17 to 20. Hereinafter, differences of the second variation from the second embodiment will be mainly described.

Figure 18:
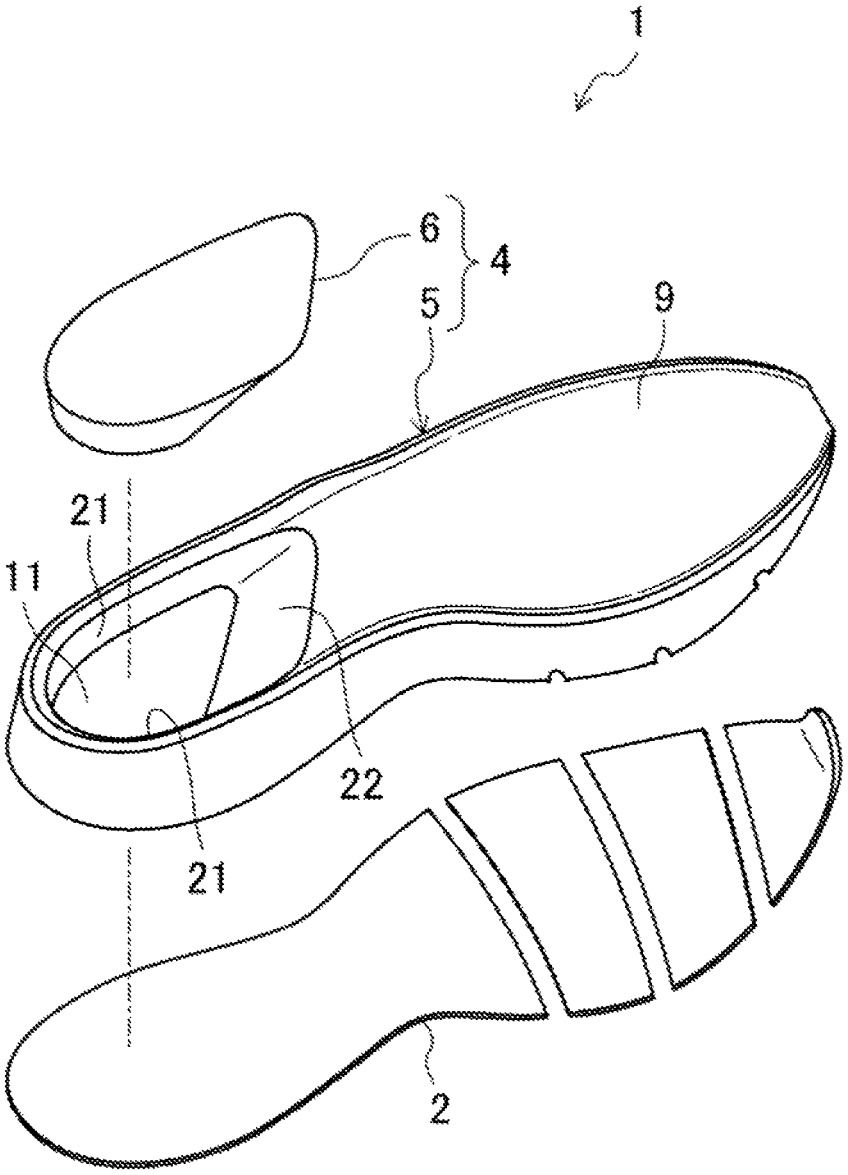
FIG. 18 is an exploded perspective view illustrating each configuration of the sole structure of the second variation of the second embodiment.
Figure 19:
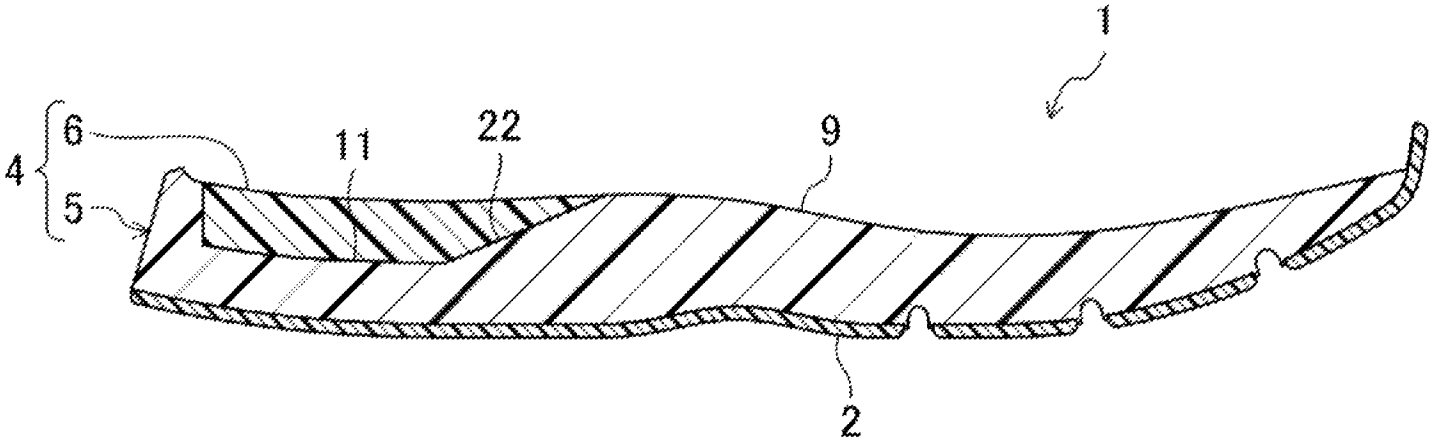
FIG. 19 is a cross-sectional view taken along line XIX-XIX illustrated in FIG. 17.
Figure 20:
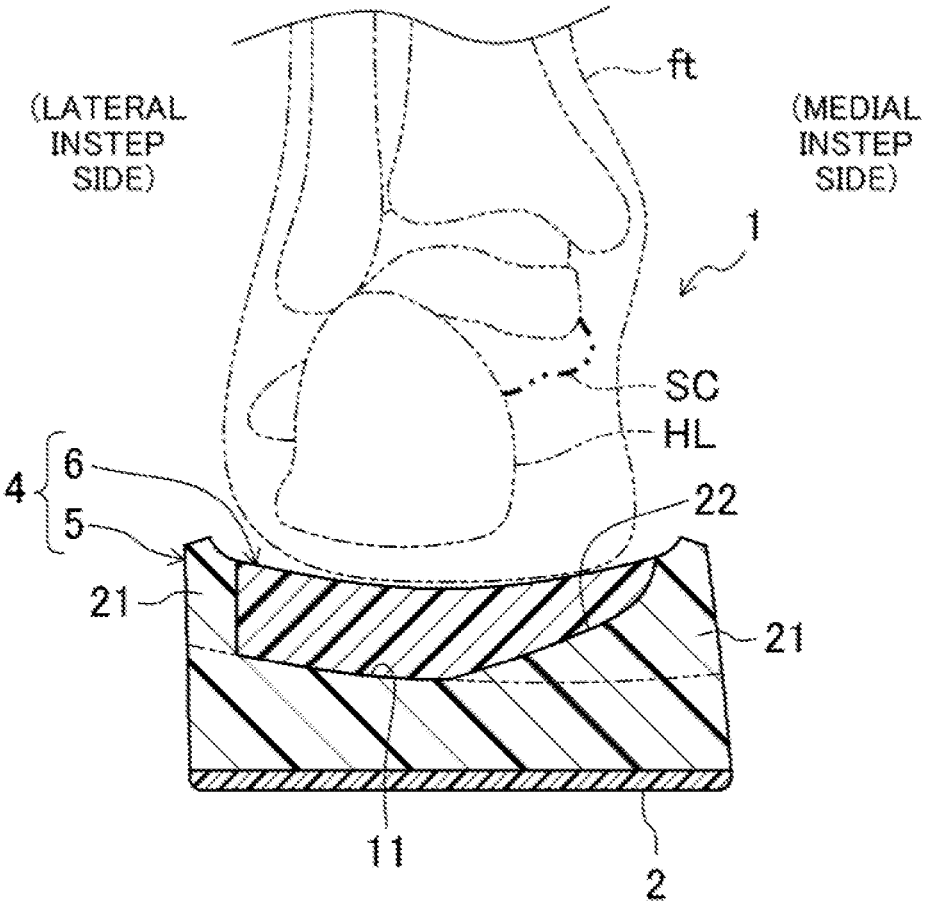
FIG. 20 is a cross-sectional view taken along line XX-XX illustrated in FIG. 17.

As illustrated in FIGS. 18 to 20, in the second variation, a sloping surface 22 is formed on the front portion of the housing portion 11. The sloping surface 22 is formed to slope rearward as extending downward from the planta contact surface 9 (the upper surface of the first midsole portion 5) in the thickness direction. In addition, the sloping surface 22 is, as viewed in plane, formed to approach a location corresponding to the hindfoot portion H of the wearer from a location corresponding to the midfoot portion M of the wearer as extending from the outer side to the inner side (see FIG. 17). The sloping surface 22 is disposed to include a location corresponding to the sustentaculum tali SC of the wearer as viewed in plane (see FIGS. 18 and 20).

As illustrated in FIGS. 17 to 20, the second midsole portion 6 is not separated into the upper thin plate portion 13 and the lower thin plate portion 14 as described in the second embodiment, but is formed as a single member. A front portion of the second midsole portion 6 is sloped to contact the sloping surface 22 in a state where the second midsole portion 6 is housed in the housing portion 11.

Since the second variation as described above has the substantially same configuration as the configuration described in the second embodiment, advantages similar to those of the second embodiment can be obtained.

OTHER EMBODIMENTS

In the first embodiment, the second embodiment, and the first variation of the second embodiment, the second midsole portion 6 includes the plurality of thin plate portions 12 (the upper thin plate portion 13 and the lower thin plate portion 14). However, this is merely a non-limiting example. For example, the second midsole portion 6 may include three or more thin plate portions 12.

Although the embodiments of the present disclosure have been described above, the present disclosure is not limited to the above embodiments, and various modifications can be made within the scope of the present disclosure.

The present disclosure is industrially usable as, for example, a sole structure 1 for a shoe applied to running or various competitions and a shoe having such a sole structure 1.

What is claimed is:

1. A sole structure for a shoe, the sole structure comprising a midsole, the midsole including:

a first midsole portion comprising:

an upper midsole portion whose upper surface is a planta contact surface contacting a planta of a wearer; and a lower midsole portion stacked below the upper midsole portion, the lower midsole portion being made of a material having a higher hardness than a material forming the upper midsole portion, wherein the upper midsole portion includes an upper recessed portion recessed upward from a lower portion of the upper midsole portion, and an upper peripheral wall portion located on inner and outer sides of the upper recessed portion in a foot width direction and protruding downward, the lower midsole portion includes a lower recessed portion recessed downward from an upper portion of the lower midsole portion, and a lower peripheral wall portion located on inner and outer sides of the lower recessed portion in the foot width direction and protruding upward; and a second midsole portion disposed at a location corresponding at least to a hindfoot portion of a foot of the wearer, the second midsole portion being stacked on the first midsole portion in a thickness direction of the midsole and being made of a material having a lower hardness than a material forming the first midsole portion, the first midsole portion and the second midsole portion having a relatively-low hardness at a location corresponding to a tuber bottom portion of a calcaneus of the foot of the wearer, and a relatively-high hardness in an area ranging from a location corresponding to a sustentaculum tali of the foot of the wearer to a location corresponding to a navicular of the foot of the wearer;

the second midsole portion includes an upper thin plate portion and a lower thin plate portion defining a thin plate shape, wherein, in a cutting plane along a foot width direction of the midsole at the location corresponding to the sustentaculum tali of the foot of the wearer, the upper thin plate portion and the lower thin plate portion each comprise a different length in the foot width direction, wherein, in the cutting plane, a center in the foot width direction of one of the upper thin plate portion and the lower thin plate portion which has a shorter length in the foot width direction is located on a relatively lateral side with respect to a center in the foot width direction of the other one of the upper thin plate portion and the lower thin plate portion which has a longer length in the foot width direction, wherein the first midsole portion includes, at a recessed portion formed at least at one of the upper midsole portion or the lower midsole portion, a space serving as a housing portion for housing the second midsole portion, wherein in the cutting plane when the midsole is cut along the foot width direction at the location corresponding to the sustentaculum tali of the foot of the wearer, the lower peripheral wall portion on the inner side in the foot width direction has a longer protruding length than the upper peripheral wall portion on the inner side in the foot width direction, wherein a wall thickness of the upper peripheral wall portion is larger on a medial side in the foot width direction of the recessed portion of the upper midsole portion than on a lateral side in the foot width direction of the upper recessed portion, and wherein a wall thickness of the lower peripheral wall portion is larger on a medial side in the foot width direction of the recessed portion of the lower midsole portion than on a lateral side in the foot width direction of the lower recessed portion.

2. The sole structure of claim 1, wherein in the cutting plane when the midsole is cut along the foot width direction at the location corresponding to the sustentaculum tali of the foot of the wearer, the upper thin plate portion and the lower thin plate portion are stacked such that inner side portions of the thin plate portions each form a step in the thickness direction of the midsole, and in the cutting plane, the second midsole portion is relatively thick at a location corresponding to the tuber bottom portion of the calcaneus of the foot of the wearer, and relatively thin in an area ranging from a location corresponding to the sustentaculum tali of the foot of the wearer to a location corresponding to the navicular of the foot of the wearer.

3. The sole structure of claim 1, further comprising an outsole stacked on a lower side of the lower midsole portion, wherein a peripheral edge portion of the outsole on an inner side in the foot width direction has at least one outer wall portion standing upward from the peripheral edge portion, and the outer wall portion is disposed on an outer surface side of the lower midsole portion at least at a location corresponding to the hindfoot portion of the foot of the wearer.

4. The sole structure of claim 1, wherein the second midsole portion has a hardness difference of 15 C or more on an Asker C scale as compared to the first midsole portion.

5. The sole structure of claim 1, wherein the second midsole portion is made of rubber foam.

6. A shoe comprising the sole structure of claim 1.

7. The sole structure of claim 1, wherein in the cutting plane when the midsole is cut along the foot width direction at the location corresponding to the sustentaculum tali of the foot of the wearer, the upper thin plate portion has a shorter length in the foot width direction than the lower thin plate portion, and the center in the foot width direction of the upper thin plate portion is located on a lateral side with respect to the center in the foot width direction of the lower thin plate portion.

8. A sole structure for a shoe, the sole structure comprising a midsole, the midsole including:

a first midsole portion; and a second midsole portion disposed at a location corresponding at least to a hindfoot portion of a foot of a wearer, the second midsole portion being stacked on the first midsole portion in a thickness direction of the midsole and being made of a material having a lower hardness than a material forming the first midsole portion, the first midsole portion and the second midsole portion having a relatively-low hardness at a location corresponding to a tuber bottom portion of a calcaneus of the foot of the wearer, and a relatively-high hardness in an area ranging from a location corresponding to a sustentaculum tali of the foot of the wearer to a location corresponding to a navicular of the foot of the wearer;

the second midsole portion includes an upper thin plate portion and a lower thin plate portion defining a thin plate shape, wherein, in a cutting plane along a foot width direction of the midsole at the location corresponding to the sustentaculum tali of the foot of the wearer, the upper thin plate portion and the lower thin plate portion each comprise a different length in the foot width direction, wherein, in the cutting plane, a center in the foot width direction of one of the upper thin plate portion and the lower thin plate portion which has a shorter length in the foot width direction is located on a relatively lateral side with respect to a center in the foot width direction of the other one of the upper thin plate portion and the lower thin plate portion which has a longer length in the foot width direction, and wherein, in the cutting plane when the midsole is cut along the foot width direction at the location corresponding to the sustentaculum tali of the foot of the wearer, the upper thin plate portion has a shorter length in the foot width direction than the lower thin plate portion, and the center in the foot width direction of the upper thin plate portion is located on a lateral side with respect to the center in the foot width direction of the lower thin plate portion.

9. The sole structure of claim 8, wherein in the cutting plane when the midsole is cut along the foot width direction at the location corresponding to the sustentaculum tali of the foot of the wearer, the upper thin plate portion and the lower thin plate portion are stacked such that inner side portions of the thin plate portions each form a step in the thickness direction of the midsole, and in the cutting plane, the second midsole portion is relatively thick at a location corresponding to the tuber bottom portion of the calcaneus of the foot of the wearer, and relatively thin in an area ranging from a location corresponding to the sustentaculum tali of the foot of the wearer to a location corresponding to the navicular of the foot of the wearer.

10. The sole structure of claim 8, wherein the second midsole portion has a hardness difference of 15 C or more on an Asker C scale as compared to the first midsole portion.

11. The sole structure of claim 8, wherein the second midsole portion is made of rubber foam.

12. A shoe comprising the sole structure of claim 8.

* * * * *